US010955188B2

(12) United States Patent
Chan

(10) Patent No.: US 10,955,188 B2
(45) Date of Patent: Mar. 23, 2021

(54) MOBILE STORAGE APPARATUS

(71) Applicant: Fridge-To-Go Limited, Hong Kong (CN)

(72) Inventor: Chik Sum Chan, Hong Kong (CN)

(73) Assignee: Fridge-To-Go Limited, Hong Kong (CN)

( * ) Notice: Subject to any disclaimer, the term of this patent is extended or adjusted under 35 U.S.C. 154(b) by 0 days.

(21) Appl. No.: 16/306,796

(22) PCT Filed: Jan. 18, 2018

(86) PCT No.: PCT/CN2018/073165

§ 371 (c)(1),
(2) Date: Dec. 3, 2018

(87) PCT Pub. No.: WO2018/133810

PCT Pub. Date: Jul. 26, 2018

(65) Prior Publication Data

US 2019/0331411 A1 Oct. 31, 2019

(30) Foreign Application Priority Data

Jan. 18, 2017 (HK) ..... 17100624.5
Jan. 23, 2017 (HK) ..... 17100832.3

(51) Int. Cl.
*F25D 11/00* (2006.01)
*F25D 31/00* (2006.01)

(52) U.S. Cl.
CPC ..... *F25D 31/005* (2013.01); *F25D 11/003* (2013.01); *F25D 11/006* (2013.01); *F25D 2400/38* (2013.01); *F25D 2500/02* (2013.01)

(58) Field of Classification Search
CPC ..... F25D 11/003; F25D 11/006; B65D 81/38
See application file for complete search history.

(56) References Cited

U.S. PATENT DOCUMENTS 3,733,836 A * 5/1973 Corini ..... F25B 21/02 62/3.61
6,474,095 B1 11/2002 Chan
(Continued)

FOREIGN PATENT DOCUMENTS

CN 104251582 A * 12/2014 ..... F25D 11/006
CN 105865116 A * 8/2016
(Continued)

*Primary Examiner* — Nelson J Nieves
(74) *Attorney, Agent, or Firm* — Gable Gotwals

(57) ABSTRACT

A mobile storage apparatus includes a cabinet having an insulated, closable storage chamber adapted to accommodate one or more objects in a temperature controlled environment. The cabinet also has or associated with a system for changing a temperature level of the storage chamber when the system is powered by a power supply. A storage chamber liner is provided and preferably formed from thin, sheet-form material arranged within the chamber adjacent one or more sides of the chamber, but spaced from one or more sides such that the liner divides a volume of the storage chamber into a main central volume for accommodating one or more objects in a temperature controlled environment and a minor peripheral volume for receiving one or more thermally conductive passive temperature control devices. In use, when a power supply to the temperature level changing system is stopped, the one or more thermally conductive passive temperature control devise reduce or slow a rate of temperature change within the main central volume of the storage chamber.

17 Claims, 13 Drawing Sheets

(56) References Cited

U.S. PATENT DOCUMENTS 6,584,797 B1 * 7/2003 Smith ..... C09K 5/047 62/371
6,968,711 B2 * 11/2005 Smith ..... C09K 5/047 62/371
8,887,515 B2 * 11/2014 Patstone ..... F25D 11/003 62/56
2002/0088244 A1 * 7/2002 Jennings ..... F25D 3/06 62/371
2004/0055313 A1 * 3/2004 Navedo ..... F25D 11/003 62/6
2004/0068992 A1 * 4/2004 Cauchy ..... F25B 21/02 62/3.61
2008/0164265 A1 7/2008 Conforti
2011/0248038 A1 10/2011 Mayer
2012/0248101 A1 * 10/2012 Tumber ..... B65D 81/3862 220/1.5
2012/0305435 A1 12/2012 Matta et al.
2013/0082044 A1 * 4/2013 Doan ..... H05B 6/6426 219/387
2013/0239606 A1 * 9/2013 Ide ..... F25D 11/00 62/452
2014/0033759 A1 * 2/2014 Ide ..... F25D 23/062 62/457.2
2014/0054297 A1 2/2014 Patstone
2014/0311170 A1 * 10/2014 Mills ..... F25D 11/003 62/62
2014/0338390 A1 * 11/2014 Pinto ..... F25D 11/006 62/441
2015/0153087 A1 * 6/2015 Yamashita ..... F28D 20/025 62/457.2
2016/0178252 A1 * 6/2016 Nakamura ..... F25B 21/04 62/3.3
2017/0023290 A1 * 1/2017 Demuth ..... F25D 25/022
2017/0038116 A1 * 2/2017 Ros ..... F25D 3/08
2018/0274843 A1 * 9/2018 Lombardo ..... F25D 3/06
2018/0283761 A1 * 10/2018 Buttiker ..... A01N 1/0273

FOREIGN PATENT DOCUMENTS

CN 107178946 A * 9/2017
JP 06026748 A * 2/1994 ..... F25D 11/006
JP 08014725 A * 1/1996
JP 2000213851 A * 8/2000 ..... F25D 11/006
WO WO-2012147677 A1 * 11/2012 ..... E04B 1/74

* cited by examiner

| Hour | Duration | Series 1 Chamber | Series 2 Freezer |
|---|---|---|---|
| 1 | 12:00 | -15.3 | -20.5 |
| | 12:15 | -15.1 | -16.2 |
| | 12:30 | -14.6 | -13.2 |
| | 12:45 | -13.8 | -11.0 |
| 2 | 13:00 | -13.0 | -9.3 |
| | 13:15 | -12.3 | -8.1 |
| | 13:30 | -11.6 | -7.1 |
| | 13:45 | -11.0 | -6.2 |
| 3 | 14:00 | -10.4 | -5.5 |
| | 14:15 | -9.8 | -4.8 |
| | 14:30 | -9.6 | -4.4 |
| | 14:45 | -9.1 | -3.8 |
| 4 | 15:00 | -8.4 | -3.2 |
| | 15:15 | -8.0 | -2.7 |
| | 15:30 | -7.4 | -2.1 |
| | 15:45 | -7.1 | -1.6 |
| 5 | 16:00 | -6.7 | -1.2 |
| | 16:15 | -6.4 | -1.0 |
| | 16:30 | -5.7 | -0.5 |
| | 16:45 | -5.3 | -0.1 |
| 6 | 17:00 | -5.0 | 0.3 |
| | 17:15 | -4.6 | 0.8 |
| | 17:30 | -4.2 | 1.2 |
| | 17:45 | -3.9 | 1.5 |
| 7 | 18:00 | -3.6 | 1.9 |
| | 18:15 | -3.1 | 2.3 |
| | 18:30 | -2.8 | 2.6 |
| | 18:45 | -2.5 | 3.0 |
| 8 | 19:00 | -2.1 | 3.3 |
| | 19:15 | -1.8 | 3.6 |
| | 19:30 | -1.5 | 3.9 |
| | 19:45 | -1.1 | 4.2 |
| 9 | 20:00 | -1.0 | 4.4 |
| | 20:15 | -0.8 | 4.6 |
| | 20:30 | -0.5 | 4.9 |
| | 20:45 | -0.3 | 5.1 |
| 10 | 21:00 | -0.2 | 5.3 |
| | 21:15 | -0.1 | 5.4 |
| | 21:30 | 0.0 | 5.5 |
| | 21:45 | 0.2 | 5.7 |
| 11 | 22:00 | 0.3 | 5.8 |
| | 22:15 | 0.4 | 5.9 |
| | 22:30 | 0.4 | 5.9 |
| | 22:45 | 0.5 | 6.0 |
| 12 | 23:00 | 0.6 | 6.1 |
| | 23:15 | 0.5 | 6.1 |
| | 23:30 | 0.6 | 6.2 |
| | 23:45 | 0.6 | 6.2 |

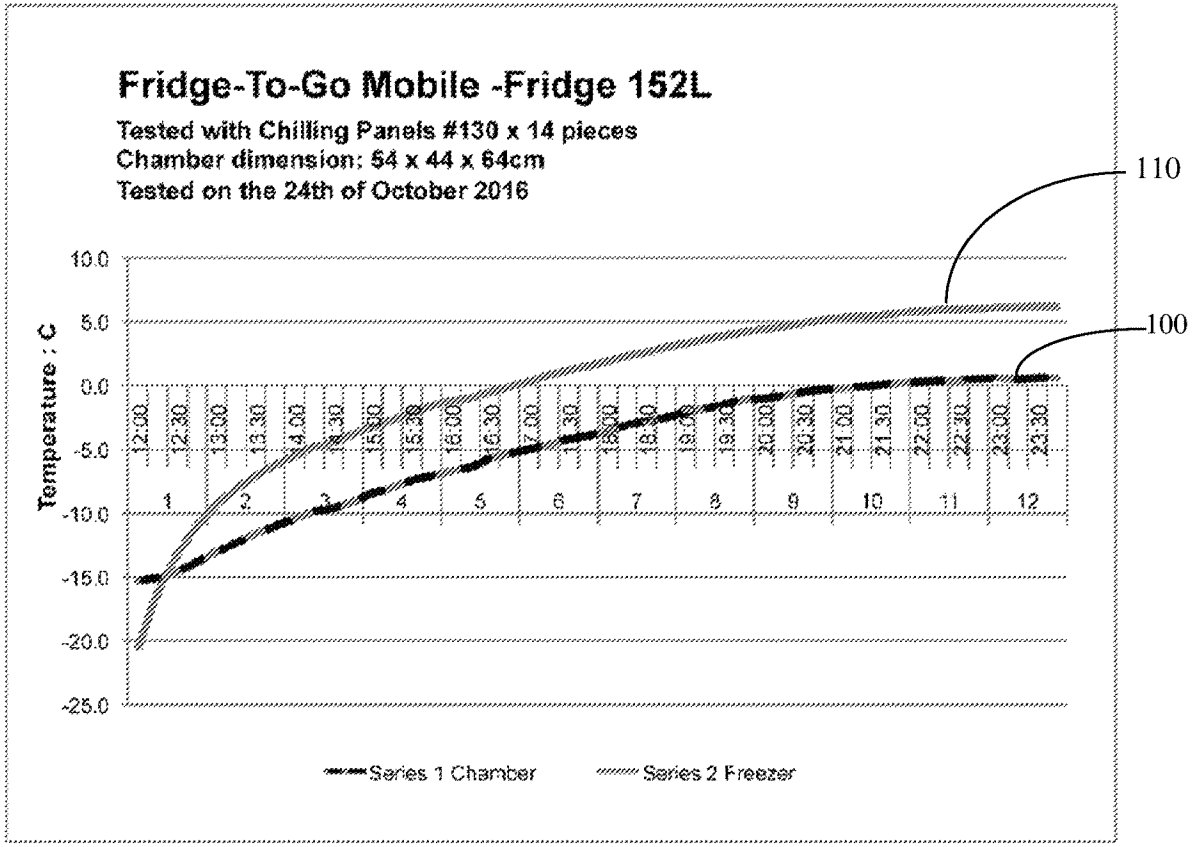

TESTING PROTOCOL:

1. Ambient temperature was between 24C to 28C
2. Fridge-to-go Chilling Panels were placed in Freezer in temperature of -20C for 12 hours and then the freezer was switched OFF
3. A probe was set at the middle of freezer compartment on the right side to measure the change of temperature of The freezer after switching OFF
4. A proble was set at the middle of chamber to measure the temperature of the Chamber
5. Close the bonnet of the Mobile Fridge and testing commenced

Fig. 7

| Hour | Duration | Series 1 Chamber | Series 2 Freezer |
|---|---|---|---|
| 1 | 19:45 | -18.6 | -18.3 |
| | 20:00 | -18.0 | -16.2 |
| | 20:15 | -17.0 | -13.3 |
| | 20:30 | -16.1 | -11.4 |
| 2 | 20:45 | -15.3 | -10.0 |
| | 21:00 | -14.5 | -9.0 |
| | 21:15 | -13.7 | -8.1 |
| | 21:30 | -13.0 | -7.3 |
| 3 | 21:45 | -12.3 | -6.6 |
| | 22:00 | -11.6 | -5.9 |
| | 22:15 | -10.9 | -5.3 |
| | 22:30 | -10.3 | -4.7 |
| 4 | 22:45 | -9.7 | -4.1 |
| | 23:00 | -9.1 | -3.5 |
| | 23:15 | -8.4 | -2.9 |
| | 23:30 | -7.6 | -2.3 |
| 5 | 23:45 | -7.2 | -1.8 |
| | 00:00 | -6.7 | -1.3 |
| | 00:15 | -6.1 | -0.8 |
| | 00:30 | -5.5 | -0.4 |
| 6 | 00:45 | -5.0 | 0.1 |
| | 01:00 | -4.5 | 0.6 |
| | 01:15 | -4.0 | 1.2 |
| | 01:30 | -3.5 | 1.7 |
| 7 | 01:45 | -3.1 | 2.2 |
| | 02:00 | -2.5 | 2.7 |
| | 02:15 | -2.1 | 3.1 |
| | 02:30 | -1.7 | 3.5 |
| 8 | 02:45 | -1.3 | 3.9 |
| | 03:00 | -1.1 | 4.2 |
| | 03:15 | -0.7 | 4.5 |
| | 03:30 | -0.1 | 4.8 |
| 9 | 03:45 | -0.2 | 5.0 |
| | 04:00 | 0.1 | 5.2 |
| | 04:15 | 0.2 | 5.4 |
| | 04:30 | 0.4 | 5.6 |
| 10 | 04:45 | 0.6 | 5.7 |
| | 05:00 | 0.6 | 5.9 |
| | 05:15 | 0.8 | 6.0 |
| | 05:30 | 0.9 | 6.1 |
| 11 | 05:45 | 1.0 | 6.2 |
| | 06:00 | 1.1 | 6.3 |
| | 06:15 | 1.1 | 6.4 |
| | 06:30 | 1.2 | 6.4 |
| 12 | 06:45 | 1.3 | 6.5 |
| | 07:00 | 1.3 | 6.6 |
| | 07:15 | 1.3 | 6.6 |
| | 07:30 | 1.4 | 6.6 |

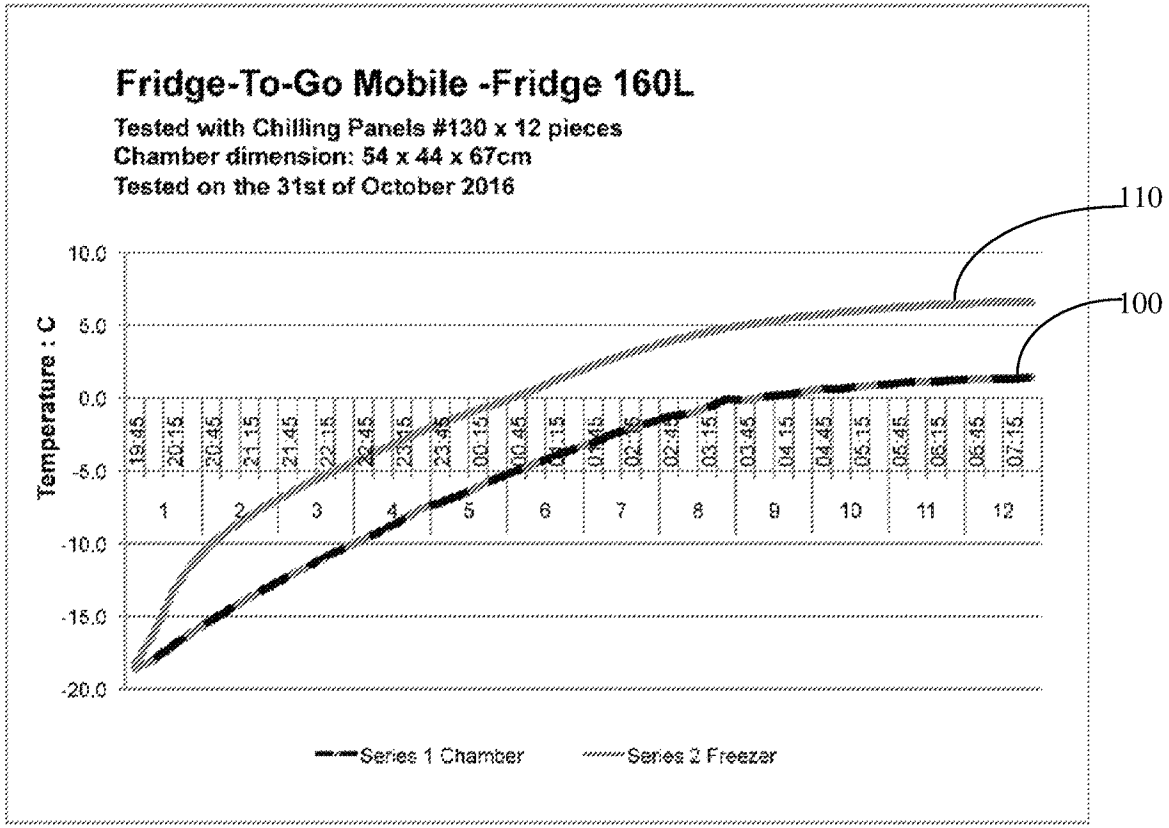

TESTING PROTOCOL:

1. Ambient temperature was between 24C to 26C
2. Fridge-to-go Chilling Panels were placed in Freezer in temperature of -20C for 12 hours and then the freezer was switched OFF
3. A probe was set at the middle of freezer compartment on the right side to measure the change of temperature of The freezer after switching OFF
4. A proble was set at the middle of chamber to measure the temperature of the Chamber
5. Close the bonnet of the Mobile Fridge and testing commenced

Fig. 8

| Hour | Duration | Series 1 Chamber | Series 2 Freezer |
|---|---|---|---|
| 13 | 07:45 | 1.4 | 6.7 |
| | 08:00 | 1.4 | 6.7 |
| | 08:15 | 1.4 | 6.7 |
| | 08:30 | 1.4 | 6.7 |
| 14 | 08:45 | 1.3 | 6.5 |
| | 09:00 | 1.3 | 6.5 |
| | 09:15 | 1.3 | 6.5 |
| | 09:30 | 1.3 | 6.4 |
| 15 | 09:45 | 1.2 | 6.3 |
| | 10:00 | 1.3 | 6.3 |
| | 10:15 | 1.3 | 6.3 |
| | 10:30 | 1.3 | 6.2 |
| 16 | 10:45 | 1.3 | 6.2 |
| | 11:00 | 1.3 | 6.2 |
| | 11:15 | 1.2 | 6.2 |
| | 11:30 | 1.3 | 6.2 |
| 17 | 11:45 | 1.3 | 6.2 |
| | 12:00 | 1.3 | 6.1 |
| | 12:15 | 1.4 | 6.1 |
| | 12:30 | 1.3 | 6.1 |
| 18 | 12:45 | 1.3 | 6.1 |
| | 13:00 | 1.3 | 6.2 |
| | 13:15 | 1.3 | 6.2 |
| | 13:30 | 1.3 | 6.2 |
| 19 | 13:45 | 1.3 | 6.2 |
| | 14:00 | 1.4 | 6.2 |
| | 14:15 | 1.3 | 6.2 |
| | 14:30 | 1.5 | 6.3 |
| 20 | 14:45 | 1.4 | 6.3 |
| | 15:00 | 1.5 | 6.3 |
| | 15:15 | 1.5 | 6.3 |
| | 15:30 | 1.4 | 6.3 |
| 21 | 15:45 | 1.4 | 6.3 |
| | 16:00 | 1.4 | 6.3 |
| | 16:15 | 1.4 | 6.3 |
| | 16:30 | 1.4 | 6.3 |
| 22 | 16:45 | 1.4 | 6.3 |
| | 17:00 | 1.4 | 6.3 |
| | 17:15 | 1.4 | 6.3 |
| | 17:30 | 1.4 | 6.3 |
| 23 | 17:45 | 1.6 | 6.3 |
| | 18:00 | 1.6 | 6.5 |
| | 18:15 | 1.6 | 6.6 |
| | 18:30 | 1.5 | 6.7 |
| 24 | 18:45 | 1.6 | 6.7 |
| | 19:00 | 1.6 | 6.8 |
| | 19:15 | 1.6 | 6.8 |
| | 19:30 | 1.6 | 6.9 |

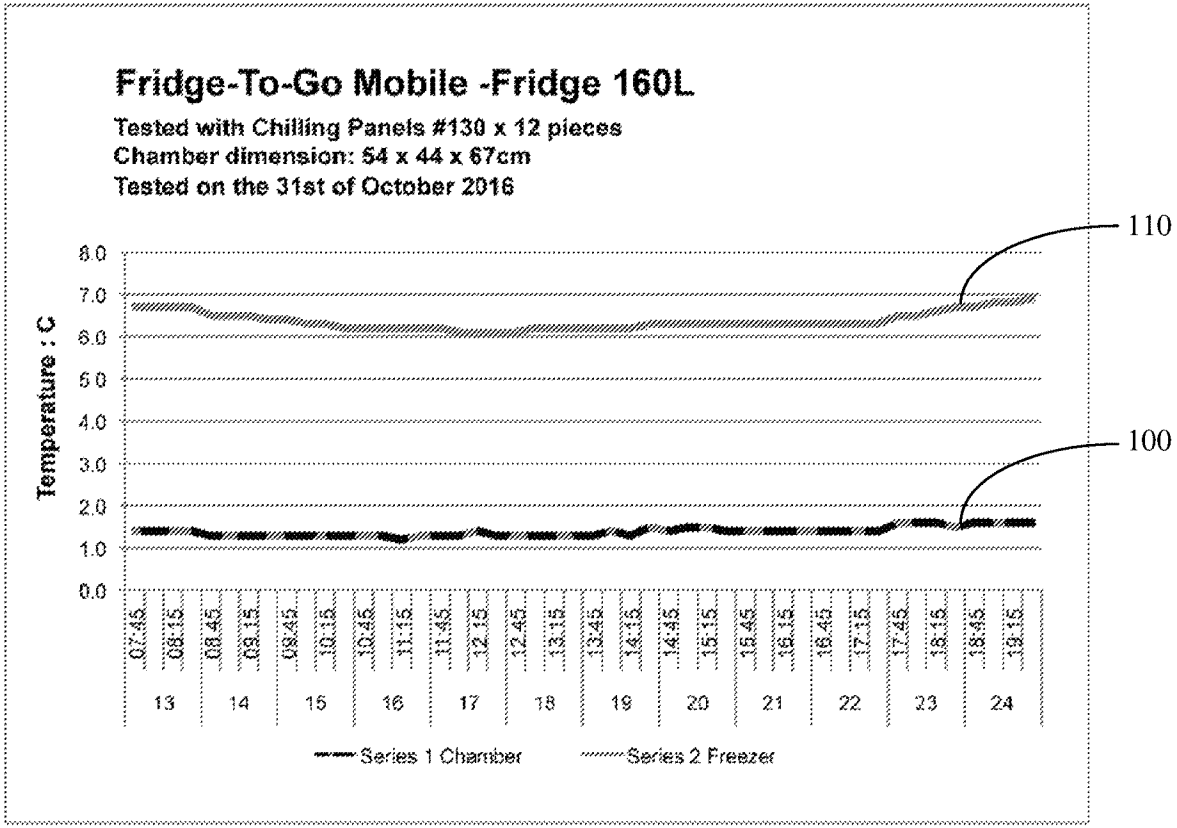

TESTING PROTOCOL:

1. Ambient temperature was between 24C to 28C
2. Fridge-to-go Chilling Panels were placed in Freezer in temperature of -20C for 12 hours and then the freezer was switched OFF
3. A probe was set at the middle of freezer compartment on the right side to measure the change of temperature of The freezer after switching OFF
4. A probe was set at the middle of chamber to measure the temperature of the Chamber
5. Close the bonnet of the Mobile Fridge and testing commenced

Fig. 9

| Hour | Duration | Series 1 Chamber | Series 2 Freezer |
|---|---|---|---|
| 1 | 15:00 | -18.9 | -19.3 |
| | 15:15 | -18.4 | -16.1 |
| | 15:30 | -17.2 | -14.3 |
| | 15:45 | -16.5 | -12.6 |
| 2 | 16:00 | -15.6 | -11.2 |
| | 16:15 | -14.9 | -10.0 |
| | 16:30 | -14.1 | -9.0 |
| | 16:45 | -13.5 | -8.2 |
| 3 | 17:00 | -12.7 | -7.6 |
| | 17:15 | -12.0 | -6.9 |
| | 17:30 | -11.4 | -6.3 |
| | 17:45 | -10.8 | -5.7 |
| 4 | 18:00 | -10.2 | -5.1 |
| | 18:15 | -9.6 | -4.5 |
| | 18:30 | -8.8 | -3.9 |
| | 18:45 | -8.4 | -3.3 |
| 5 | 19:00 | -7.7 | -2.7 |
| | 19:15 | -7.1 | -2.2 |
| | 19:30 | -6.6 | -1.8 |
| | 19:45 | -6.0 | -1.2 |
| 6 | 20:00 | -5.6 | -0.8 |
| | 20:15 | -5.0 | -0.4 |
| | 20:30 | -4.6 | -0.2 |
| | 20:45 | -4.1 | 0.3 |
| 7 | 21:00 | -3.6 | 0.7 |
| | 21:15 | -3.2 | 1.3 |
| | 21:30 | -2.8 | 1.8 |
| | 21:45 | -2.3 | 2.3 |
| 8 | 22:00 | -1.9 | 2.7 |
| | 22:15 | -1.6 | 3.1 |
| | 22:30 | -1.2 | 3.5 |
| | 22:45 | -0.9 | 3.8 |
| 9 | 23:00 | -0.6 | 4.1 |
| | 23:15 | -0.3 | 4.4 |
| | 23:30 | -0.1 | 4.6 |
| | 23:45 | 0.1 | 4.8 |
| 10 | 00:00 | 0.3 | 5.0 |
| | 00:15 | 0.5 | 5.2 |
| | 00:30 | 0.7 | 5.4 |
| | 00:45 | 0.7 | 5.5 |
| 11 | 01:00 | 0.8 | 5.6 |
| | 01:15 | 1.0 | 5.7 |
| | 01:30 | 0.9 | 1.3 |
| | 01:45 | 0.5 | 1.3 |
| 12 | 02:00 | 0.6 | 2.7 |
| | 02:15 | 0.7 | 3.8 |
| | 02:30 | 0.9 | 4.7 |
| | 02:45 | 0.9 | 5.3 |

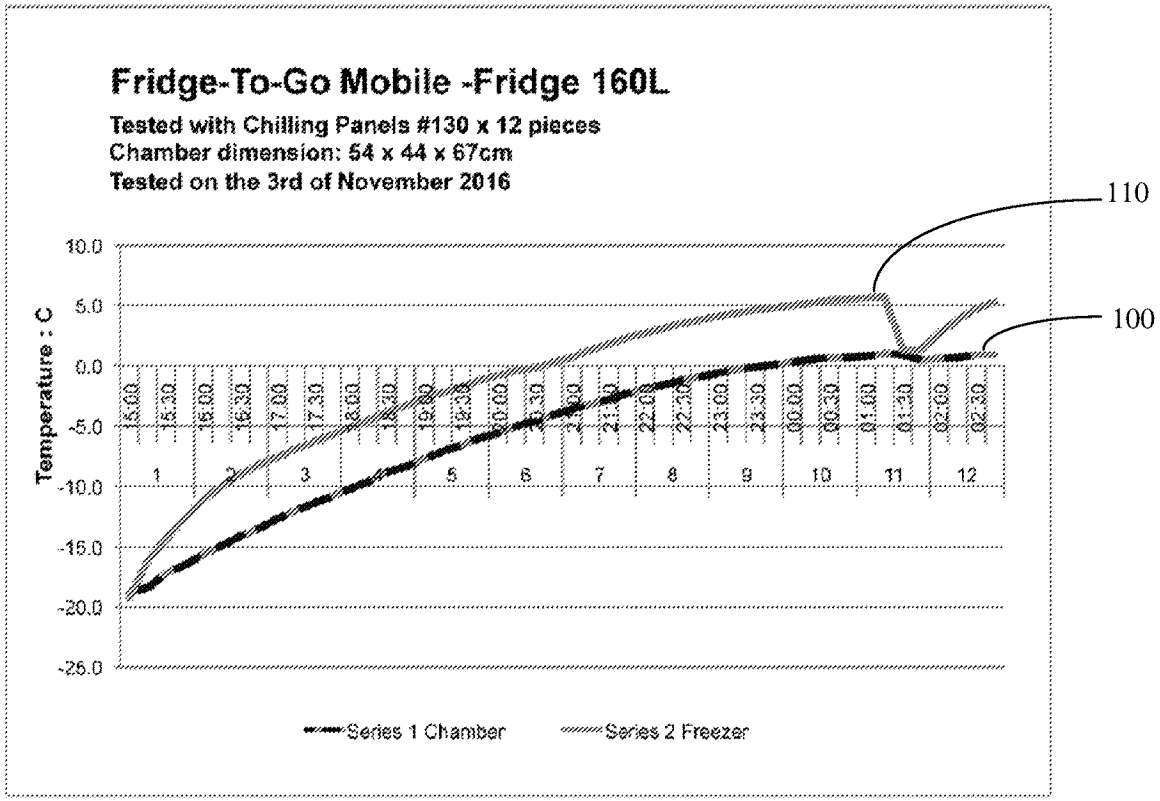

TESTING PROTOCOL:

1. Ambient temperature was between 23C to 27C
2. Fridge-to-go Chilling Panels were placed in Freezer in temperature of -20C for 12 hours and then the freezer was switched OFF
3. A probe was set at the middle of freezer compartment on the right side to measure the change of temperature
4. A probe was set at the middle of chamber to measure the temperature of the Chamber
5. Close the bonnet of the Mobile Fridge and testing commenced
6. The freezer was switched ON at 01:00 for 2 hours and switched OFF again

Fig. 10

| Hour | Duration | Series 1 Chamber | Series 2 Freezer |
|---|---|---|---|
| 13 | 03:00 | 1.0 | 5.6 |
| | 03:15 | 1.1 | 5.8 |
| | 03:30 | 1.2 | 6.0 |
| | 03:45 | 1.2 | 6.1 |
| 14 | 04:00 | 1.3 | 6.2 |
| | 04:15 | 1.3 | 6.2 |
| | 04:30 | 1.4 | 6.2 |
| | 04:45 | 1.4 | 6.2 |
| 15 | 05:00 | 1.4 | 6.2 |
| | 05:15 | 1.3 | 6.3 |
| | 05:30 | 1.2 | 1.5 |
| | 05:45 | 1.0 | 1.6 |
| 16 | 06:00 | 1.1 | 3.0 |
| | 06:15 | 1.2 | 4.2 |
| | 06:30 | 1.3 | 5.2 |
| | 06:45 | 1.4 | 5.7 |
| 17 | 07:00 | 1.4 | 6.1 |
| | 07:15 | 1.4 | 6.2 |
| | 07:30 | 1.5 | 6.4 |
| | 07:45 | 1.4 | 6.4 |
| 18 | 08:00 | 1.6 | 6.5 |
| | 08:15 | 1.5 | 6.5 |
| | 08:30 | 1.5 | 6.5 |
| | 08:45 | 1.4 | 6.3 |
| 19 | 09:00 | 1.5 | 6.4 |
| | 09:15 | 1.5 | 6.3 |
| | 09:30 | 1.4 | 6.2 |
| | 09:45 | 1.4 | 6.1 |
| 20 | 10:00 | 1.4 | 6.0 |
| | 10:15 | 1.4 | 6.0 |
| | 10:30 | 1.4 | 5.9 |
| | 10:45 | 1.4 | 5.9 |
| 21 | 11:00 | 1.4 | 5.9 |
| | 11:15 | 1.4 | 5.9 |
| | 11:30 | 1.3 | 5.9 |
| | 11:45 | 1.4 | 5.9 |
| 22 | 12:00 | 1.4 | 5.9 |
| | 12:15 | 1.4 | 5.9 |
| | 12:30 | 1.4 | 5.9 |
| | 12:45 | 1.3 | 5.9 |
| 23 | 13:00 | 1.4 | 5.9 |
| | 13:15 | 1.3 | 5.9 |
| | 13:30 | 1.4 | 5.9 |
| | 13:45 | 1.4 | 5.9 |
| 24 | 14:00 | 1.3 | 5.9 |
| | 14:15 | 1.4 | 5.9 |
| | 14:30 | 1.4 | 5.9 |
| | 14:45 | 1.4 | 5.9 |

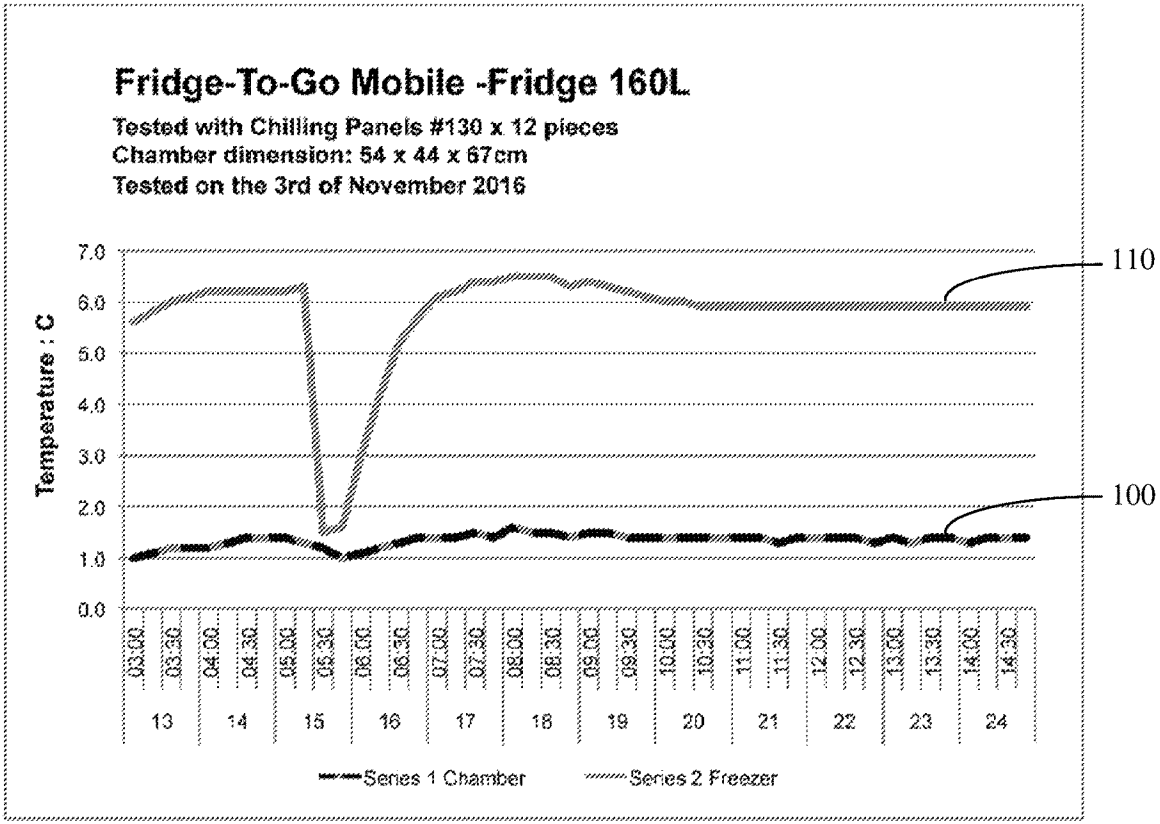

TESTING PROTOCOL:

1. Ambient temperature was between 23C to 27C
2. Fridge-to-go Chilling Panels were placed in Freezer in temperature of -20C for 12 hours and then the freezer was switched OFF
3. A probe was set at the middle of freezer compartment on the right side to measure the change of temperature of The freezer after switching OFF
4. A probe was set at the middle of chamber to measure the temperature of the Chamber
5. Close the bonnet of the Mobile Fridge and testing commenced
6. The freezer was switched ON at 05:00 for 2 hours and switched OFF again.

Fig. 11

| Hour | Duration Series 1/2 | Series 1 Chamber | Series 2 Freezer | Series 3 Freezer | Duration Series 3 |
|---|---|---|---|---|---|
| 1 | 19:45 | [illegible] | [illegible] | -13.4 | 12:45 |
| | 20:00 | -18.0 | -16.3 | -13.4 | 13:00 |
| | 20:15 | -17.0 | -13.3 | -8.9 | 13:15 |
| | 20:30 | -16.1 | -11.4 | -5.2 | 13:30 |
| 2 | 20:45 | [illegible] | [illegible] | -2.1 | 13:45 |
| | 21:00 | -14.5 | -9.0 | 0.3 | 14:00 |
| | 21:15 | -13.7 | -8.1 | 2.2 | 14:15 |
| | 21:30 | -13.0 | -7.3 | 4.3 | 14:30 |
| 3 | 21:45 | [illegible] | [illegible] | 6.3 | 14:45 |
| | 22:00 | -11.6 | -5.9 | 8.2 | 15:00 |
| | 22:15 | -10.9 | -5.3 | 9.8 | 15:15 |
| | 22:30 | -10.3 | -4.7 | 11.3 | 15:30 |
| 4 | 22:45 | [illegible] | [illegible] | 12.7 | 15:45 |
| | 23:00 | -9.1 | -3.5 | 13.9 | 16:00 |
| | 23:15 | -8.4 | -2.9 | 14.9 | 16:15 |
| | 23:30 | -7.6 | -2.3 | 15.8 | 16:30 |
| 5 | 23:45 | [illegible] | [illegible] | 16.6 | 16:45 |
| | 00:00 | -6.7 | -1.3 | 17.5 | 17:00 |
| | 00:15 | -6.1 | -0.8 | 18.2 | 17:15 |
| | 00:30 | -5.5 | -0.4 | 18.8 | 17:30 |
| 6 | 00:45 | [illegible] | [illegible] | 19.3 | 17:45 |
| | 01:00 | -4.5 | 0.6 | 19.6 | 18:00 |
| | 01:15 | -3.0 | 1.2 | 20.0 | 18:15 |
| | 01:30 | -3.5 | 1.7 | 20.5 | 18:30 |
| 7 | 01:45 | [illegible] | [illegible] | 20.8 | 18:45 |
| | 02:00 | -2.5 | 2.7 | 21.1 | 19:00 |
| | 02:15 | -2.1 | 3.1 | 21.4 | 19:15 |
| | 02:30 | -1.7 | 3.5 | 21.7 | 19:30 |
| 8 | 02:45 | [illegible] | [illegible] | 21.9 | 19:45 |
| | 03:00 | -1.1 | 4.2 | 22.2 | 20:00 |
| | 03:15 | -0.7 | 4.5 | 22.4 | 20:15 |
| | 03:30 | -0.1 | 4.8 | 22.7 | 20:30 |
| 9 | 03:45 | [illegible] | [illegible] | 23.0 | 20:45 |
| | 04:00 | 0.1 | 5.2 | 23.3 | 21:00 |
| | 04:15 | 0.2 | 5.4 | 23.6 | 21:15 |
| | 04:30 | 0.4 | 5.6 | 23.8 | 21:30 |
| 10 | 04:45 | [illegible] | [illegible] | 24.1 | 21:45 |
| | 05:00 | 0.6 | 5.9 | 24.3 | 22:00 |
| | 05:15 | 0.8 | 6.0 | 24.5 | 22:15 |
| | 05:30 | 0.9 | 6.1 | 24.6 | 22:30 |
| 11 | 05:45 | [illegible] | [illegible] | 24.8 | 22:45 |
| | 06:00 | 1.1 | 6.3 | 25.0 | 23:00 |
| | 06:15 | 1.1 | 6.4 | 25.1 | 23:15 |
| | 06:30 | 1.2 | 6.4 | 25.2 | 23:30 |
| 12 | 06:45 | [illegible] | [illegible] | 25.3 | 23:45 |
| | 07:00 | 1.3 | 6.6 | 25.4 | 00:00 |
| | 07:15 | 1.3 | 6.6 | 25.5 | 00:15 |
| | 07:30 | 1.4 | 6.6 | 25.6 | 00:30 |

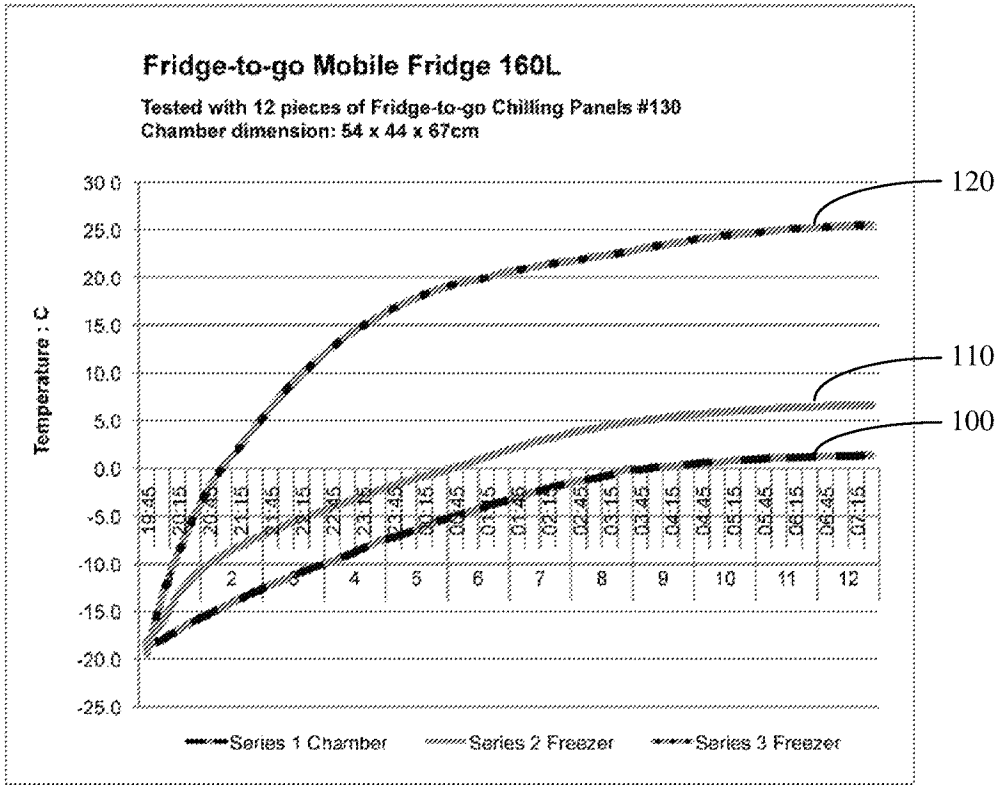

TESTING PROTOCOL:

1. Ambient temperature was between 23C to 27C
2. Fridge-to-go Chilling Panels were placed in Freezer in temperature of -20C for 12 hours and then the freezer was switched OFF
3. Series 2 - A probe was set in the middle of freezer compartment on the right side to measure the the temperature of the freezer with the mount of Fridge-to-go chilling panels.
4. Series 1 - A probe was set in the middle of chamber where as Fridge-to-go chilling panels were mounted, measuring the temperature of the said chamber.
5. Series 3 - A probe was set in the middle of chamber where as NO Fridge-to-go chilling panels were mounted, measuring the temperature of the said chamber.
6. Close the lid of Freezer and test commenced.

Fig. 12

| Hour | Duration Series 1/2 | Series 1 Chamber | Series 2 Freezer | Series 3 Freezer | Duration Series 3 |
|---|---|---|---|---|---|
| 13 | 07:45 | 1.3 | 6.2 | 25.7 | 00:45 |
| | 08:00 | 1.4 | 6.2 | 25.8 | 01:00 |
| | 08:15 | 1.4 | 6.2 | 25.9 | 01:15 |
| | 08:30 | 1.4 | 6.2 | 25.9 | 01:30 |
| 14 | 08:45 | 1.3 | 6.3 | 26.0 | 01:45 |
| | 09:00 | 1.3 | 6.3 | 26.0 | 02:00 |
| | 09:15 | 1.3 | 6.3 | 26.1 | 02:15 |
| | 09:30 | 1.3 | 6.4 | 26.1 | 02:30 |
| 15 | 09:45 | 1.3 | 6.3 | 26.2 | 02:45 |
| | 10:00 | 1.3 | 6.3 | 26.2 | 03:00 |
| | 10:15 | 1.3 | 6.3 | 26.2 | 03:15 |
| | 10:30 | 1.3 | 6.2 | 26.3 | 03:30 |
| 16 | 10:45 | 1.3 | 6.2 | 26.3 | 03:45 |
| | 11:00 | 1.3 | 6.2 | 26.4 | 04:00 |
| | 11:15 | 1.2 | 6.2 | 26.4 | 04:15 |
| | 11:30 | 1.3 | 6.2 | 26.4 | 04:30 |
| 17 | 11:45 | 1.3 | 6.2 | 26.4 | 04:45 |
| | 12:00 | 1.3 | 6.1 | 26.5 | 05:00 |
| | 12:15 | 1.4 | 6.1 | 26.5 | 05:15 |
| | 12:30 | 1.3 | 6.1 | 26.5 | 05:30 |
| 18 | 12:45 | 1.3 | 6.2 | 26.5 | 05:45 |
| | 13:00 | 1.3 | 6.2 | 26.5 | 06:00 |
| | 13:15 | 1.3 | 6.2 | 26.6 | 06:15 |
| | 13:30 | 1.3 | 6.2 | 26.6 | 06:30 |
| 19 | 13:45 | 1.3 | 6.2 | 26.6 | 06:45 |
| | 14:00 | 1.4 | 6.2 | 26.6 | 07:00 |
| | 14:15 | 1.3 | 6.2 | 26.6 | 07:15 |
| | 14:30 | 1.5 | 6.3 | 26.6 | 07:30 |
| 20 | 14:45 | 1.5 | 6.3 | 26.6 | 07:45 |
| | 15:00 | 1.5 | 6.3 | 26.6 | 08:00 |
| | 15:15 | 1.5 | 6.3 | 26.6 | 08:15 |
| | 15:30 | 1.4 | 6.3 | 26.7 | 08:30 |
| 21 | 15:45 | 1.4 | 6.3 | 26.6 | 08:45 |
| | 16:00 | 1.4 | 6.3 | 26.5 | 09:00 |
| | 16:15 | 1.4 | 6.3 | 26.4 | 09:15 |
| | 16:30 | 1.4 | 6.3 | 26.3 | 09:30 |
| 22 | 16:45 | 1.4 | 6.3 | 26.2 | 09:45 |
| | 17:00 | 1.4 | 6.3 | 26.0 | 10:00 |
| | 17:15 | 1.4 | 6.3 | 25.8 | 10:15 |
| | 17:30 | 1.4 | 6.3 | 25.8 | 10:30 |
| 23 | 17:45 | 1.5 | 6.3 | 25.7 | 10:45 |
| | 18:00 | 1.6 | 6.8 | 25.6 | 11:00 |
| | 18:15 | 1.6 | 6.8 | 25.4 | 11:15 |
| | 18:30 | 1.5 | 6.7 | 25.4 | 11:30 |
| 24 | 18:45 | 1.6 | 6.8 | 25.3 | 11:45 |
| | 19:00 | 1.6 | 6.8 | 25.2 | 12:00 |
| | 19:15 | 1.6 | 6.8 | 25.1 | 12:15 |
| | 19:30 | 1.6 | 6.9 | 25.0 | 12:30 |

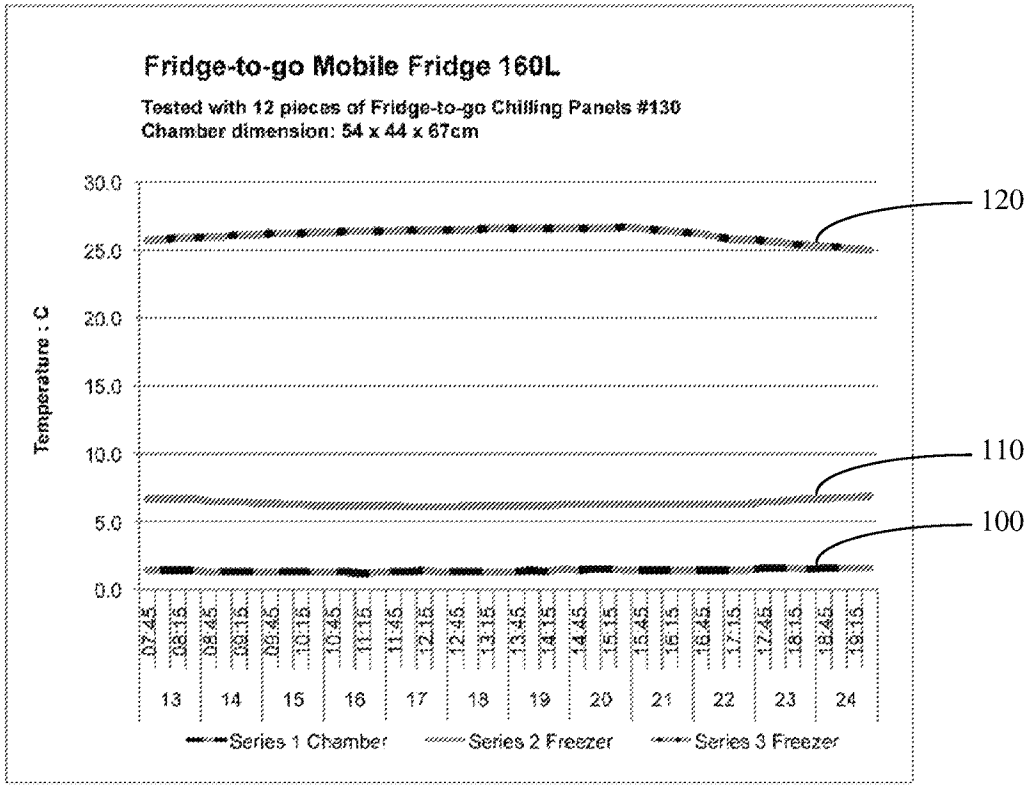

TESTING PROTOCOL:

1. Ambient temperature was between 23C to 27C
2. Fridge-to-go Chilling Panels were placed in Freezer in temperature of -20C for 12 hours and then the freezer was switched OFF
3. Series 2 - A probe was set in the middle of freezer compartment on the right side to measure the the temperature of the freezer with the mount of Fridge-to-go chilling panels.
4. Series 1 - A probe was set in the middle of chamber where as Fridge-to-go chillling panels were mounted, measuring the temperature of the said chamber.
5. Series 3 - A probe was set in the middle of chamber where as NO Fridge-to-go chilling panels were mounted, measuring the temperature of the said chamber.
6. Close the lid of Freezer and test commenced.

Fig. 13

MOBILE STORAGE APPARATUS

CROSS-REFERENCE TO RELATED APPLICATIONS

This United States application is the National Phase of PCT Application No. PCT/CN2018/073165 filed 18 Jan. 2018, which claims priority to Hong Kong Patent Applications No. 17100624.5 filed 18 Jan. 2017 and application Ser. No. 17/100,832.3 filed 23 Jan. 2017, each of which is incorporated herein by reference.

TECHNICAL FIELD

The invention relates to a mobile storage apparatus including means adapted to reduce or slow a rate of temperature change within a storage chamber when power to an apparatus containing the storage chamber is stopped.

BACKGROUND ART

Containers for maintaining contents at elevated or lowered temperatures are known. One example of a container for holding contents at a lowered temperature is commonly referred to as a "cool box" or a "cold box", although the container may not actually comprise a box as such. For example, U.S. Pat. No. 6,474,095 discloses a cool box comprising a collapsible container having a number of walls which are movable relative to one another between a collapsed configuration in which at least a major surface of at least two of the walls are in contact with each other, and an expanded configuration in which the walls define a cavity adapted to receive contents.

Storage boxes can be employed for critical applications such as the transport of transplantable human organs where maintaining the temperature of the organ to be transplanted within a relatively narrow lowered temperature range is critical to the health of the organ, or the storage of temperature sensitive vaccines or the like.

Storage boxes do, however, have limitations in usually being small in size to enable them to be manually carried and in being formed of relatively lightweight materials which restricts their ability to keep stored contents at a desired temperature level or within a desired temperature range for long periods.

OBJECTS OF THE INVENTION

An object of the invention is to mitigate or obviate to some degree one or more problems associated with prior art storage or transport containers.

The above object is met by the combination of features of the main claims; the subclaims disclose further advantageous embodiments of the invention.

Another object of the invention is to provide an improved storage apparatus employing passive means for reducing a rate of temperature change within a storage chamber.

Another object of the invention is to provide an improved refrigeration apparatus.

One skilled in the art will derive from the following description other objects of the invention. Therefore, the foregoing statements of object are not exhaustive and serve merely to illustrate some of the many objects of the present invention.

SUMMARY OF INVENTION

In a first main aspect, the invention provides a mobile storage apparatus comprising a cabinet preferably having a wheeled base. Preferably, a plurality of wheels is mounted to the base rendering the cabinet mobile, although the cabinet may be rendered mobile by virtue of being of a size and weight that enables it to be manually carried on a vehicle such in an automobile trunk or on a motorcycle rack. The cabinet comprises an insulated, closable storage chamber adapted to accommodate one or more objects in a temperature controlled environment. It may also have an associated power supply or a power supply connection point for connecting to a power supply to power, at least periodically, a system for changing a temperature level of said storage chamber. Also provided is a storage chamber liner. The storage chamber liner is preferably formed from thin, sheet-form material. The liner is arranged within the chamber adjacent at least one side, and preferably adjacent a plurality of sides, of the chamber, but spaced from said one or more sides such that said liner divides a volume of said storage chamber into a main central volume for accommodating one or more objects in a temperature controlled environment and a minor peripheral volume for receiving one or more thermally conductive passive temperature control devices. The arrangement is such that, when a power supply to the temperature level change system is stopped, the one or more thermally conductive passive temperature control devices reduce or slow a rate of temperature change within the main central volume of the storage chamber.

In one embodiment, the mobile storage apparatus comprises a mobile refrigeration apparatus; the storage chamber comprises a refrigeration chamber; the temperature changing system comprises a refrigeration system for reducing a temperature level of said refrigeration chamber when the refrigeration system is powered by a power supply; the storage chamber liner comprises a refrigeration chamber liner; and the one or more thermally conductive passive temperature control devices comprise one or more thermally conductive passive cooling devices to control the temperature level of the refrigeration chamber by reducing a rate of temperature rise within the main central volume of the refrigeration chamber when the power supply to the refrigeration system is stopped.

Preferably, the refrigeration system has an associated compressor, a condenser and an expansion valve. The compressor, condenser and expansion valve may be integrated with the refrigeration apparatus. Or, the compressor, condenser and expansion valve may be formed as a stand-alone unit which is connected as required to the refrigeration apparatus to cool or freeze the refrigeration chamber. Or, the compressor, condenser and expansion valve may be formed as a detachable unit which is connected as required to the refrigeration apparatus to cool or freeze the refrigeration chamber.

In another embodiment, the mobile storage apparatus comprises a mobile warming apparatus; the storage chamber comprises a warming chamber; the temperature changing system comprises a heating system for raising a temperature level of said warming chamber when the heating system is powered by a power supply; the storage chamber liner comprises a warming chamber liner; and the one or more thermally conductive passive temperature control devices comprise one or more thermally conductive passive heating devices to control the temperature level of the warming chamber by reducing a rate of temperature fall within the main central volume of the warming chamber when the power supply to the heating system is stopped.

Preferably, the heating system has an associated heating element. The heating system may be integrated with the warming apparatus. Or, the heating system may be formed as a stand-alone unit which is connected as required to the warming apparatus to warm up the storage chamber. Or, the heating system may be formed as a detachable unit which is connected as required to the warming apparatus to warm up the storage chamber.

In a second main aspect, the invention provides a method of preparing a mobile storage apparatus. The method may include providing a cabinet of said apparatus with a wheeled base to render the cabinet mobile or forming said cabinet of a size and weight that enables it to be manually carried, at least short distances. The method includes arranging a storage chamber liner in an insulated, closable storage chamber of said storage apparatus including arranging said liner within the chamber adjacent one or more sides of the chamber, but spaced from said one or more sides such that said liner divides a volume of said chamber into a main central volume for accommodating one or more objects in a temperature controlled environment and a minor peripheral volume for receiving one or more thermally conductive passive temperature control devices. When a power supply to the temperature level change system is stopped, the one or more thermally conductive passive temperature control devices reduce or slow a rate of temperature change within the main central volume of the storage chamber.

In a third main aspect, the invention provides a method of storing objects in a storage chamber of a storage apparatus according to the first aspect of the invention and placing objects to be maintained in a temperature controlled environment within the main central volume of the storage chamber.

The summary of the invention does not necessarily disclose all the features essential for defining the invention; the invention may reside in a sub-combination of the disclosed features.

BRIEF DESCRIPTION OF DRAWINGS

The foregoing and further features of the present invention will be apparent from the following description of preferred embodiments which are provided by way of example only in connection with the accompanying figures, of which.

Figure 1:
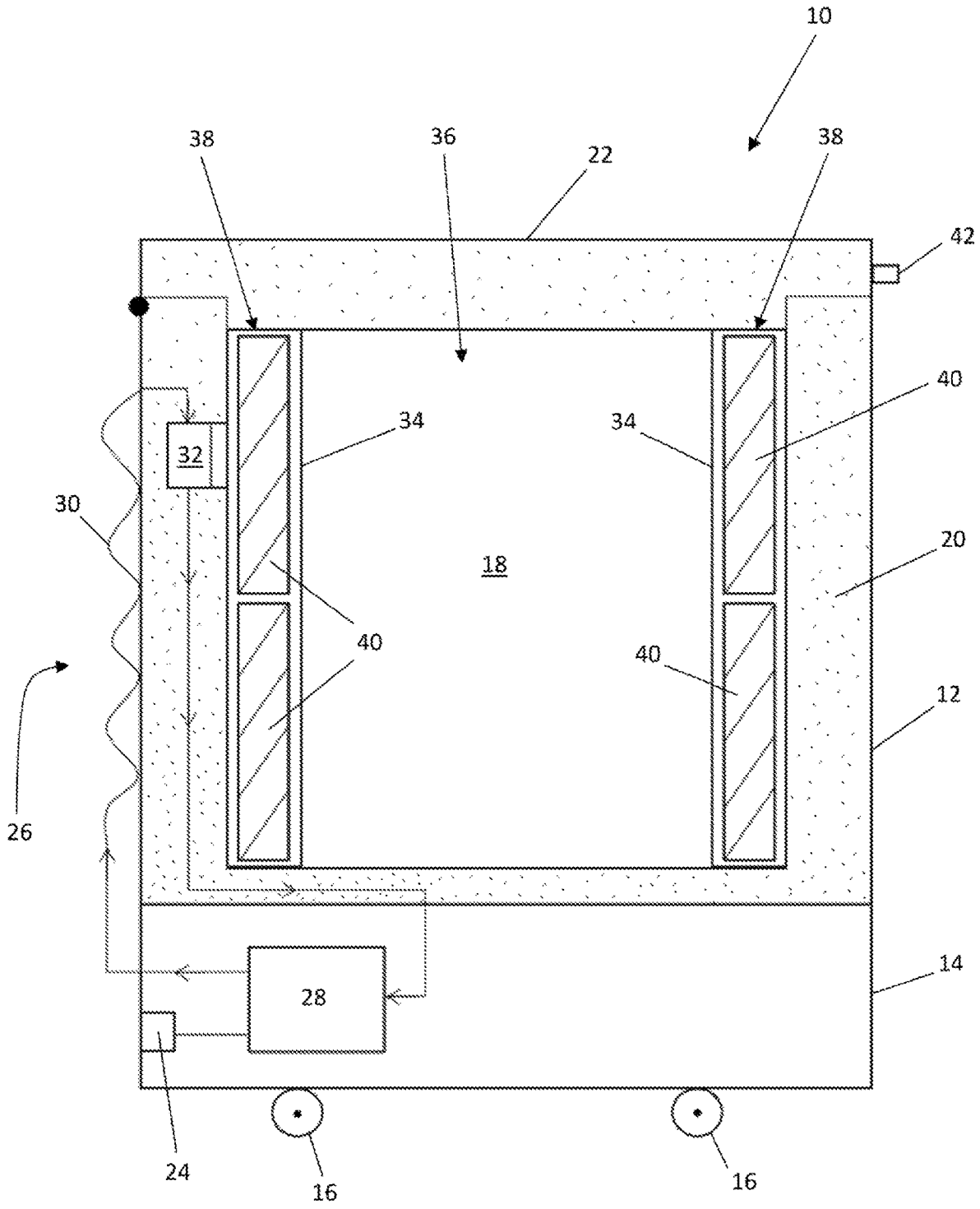
FIG. 1 is a side view of a mobile storage apparatus in accordance with a first embodiment of the invention.

The foregoing and further features of the present invention will be further apparent from the following figures of test results, of which:

FIG. 7 comprises the comparative results for a test conducted on a 201 litre refrigeration apparatus having a 152 litre part of its original chamber modified in accordance with the invention to thereby compare temperature profiles over time for an unmodified part of the refrigeration apparatus chamber operating in a conventional mode and for the refrigeration apparatus chamber part adapted according to the present invention;

FIG. 8 comprises the comparative results for another test conducted on a 201 litre refrigeration apparatus having a 160 litre part of its original chamber modified in accordance with the invention to thereby compare temperature profiles over time for an unmodified part of the refrigeration apparatus chamber operating in a conventional mode and for the refrigeration apparatus chamber part adapted according to the present invention;

FIG. 9 comprises a second set of comparative results for the refrigeration apparatus having a 160 litre chamber part modified according to the invention;

FIG. 10 comprises a third set of comparative results for the refrigeration apparatus having a 160 litre chamber part modified according to the invention;

FIG. 11 comprises a fourth set of comparative results for the refrigeration apparatus having a 160 litre chamber part modified according to the invention;

FIG. 12 comprises a fifth set of comparative results for the refrigeration apparatus having a 160 litre chamber part modified according to the invention; and FIG. 13 comprises a sixth set of comparative results for the refrigeration apparatus having a 160 litre chamber part modified according to the invention.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

References to the term "mobile" in this specification may refer to embodiments in which a cabinet of the storage apparatus has a wheeled based to render said cabinet mobile and/or to a cabinet formed of a size and weight which enables it to be manually carried or lifted, at least for short distances.

References to the term "refrigeration" also comprises references to "freezing", although not exclusively so.

References to the term "warming" comprise references to maintaining an elevated temperature level.

References to the term "manually" refer to an activity carried out by a person without the aid of tools.

Referring to FIG. 1, there is provided a mobile storage apparatus 10 comprising a cabinet 12 having a wheeled base 14. Preferably, a plurality of wheels 16 is mounted to the base 12 rendering the cabinet 12 mobile, i.e. the cabinet 12 can be manually pushed from one location to another including loading it into a truck or the like for transport. The wheels 16 are preferably ruggedised wheels.

Whilst the following description of this embodiment refers to a mobile refrigeration apparatus 10, it will be understood that the apparatus 10 could equally be used as a warming apparatus or heat retention apparatus where the refrigeration system 26 for cooling the storage chamber 18 of the apparatus is replaced by a heating system for raising a temperature level of the storage chamber 18.

Where this embodiment comprises a mobile refrigeration apparatus 10, the cabinet 12 comprises an insulated, closable refrigeration chamber 18 adapted to accommodate one or more objects (not shown) in a cool refrigerated environment provided within the chamber 18. As shown, the surrounding walls of the chamber 18 are formed or filled with an insulation material 20, denoted by dotted shading in FIG. 1. The chamber 18 is closable by a lid 22 which is also insulated. The embodiment of a refrigeration apparatus 10 shown in FIG. 1 is commonly referred to as a 'chest' freezer and/or fridge, but it will be understood from the following that the present invention is equally applicable to other forms of powered refrigeration apparatuses including those having front-face opening doors.

The cabinet 12 also has a power supply connection point 24 for connecting to a power supply to power, at least periodically, a refrigeration system 26 for cooling said refrigeration chamber 18. Preferably, the power supply connection point 24 is adapted to connect to a mains, AC 240 volt power supply or the like (not shown) to receive power at a rate sufficient to power the refrigeration system 26 to cool the refrigeration chamber 18. The refrigeration system 26 may be arranged to cool the chamber 18 to freezing, e.g. 0 degrees celsius. In some embodiments, the refrigeration system 26 may be arranged to cool the chamber 18 to considerably below freezing, e.g. in the range of minus 18 to 20 degrees celsius. Preferably, the refrigeration system comprises a conventional system including a compressor 28 mounted within the base 14, a condenser 30 mounted to a rear side of the cabinet 12 and an expansion valve 32 which may also be mounted adjacent the rear side of the cabinet 12 or at any suitable location within the apparatus 10.

A refrigeration chamber liner 34 is provided. Whilst the liner 34 is shown positioned on both sides of the chamber 18 in FIG. 1, it will be understood that, in this embodiment, the liner 34 is provided adjacent to each of the four vertical side walls of the chamber 18 as better seen in FIG. 4. The refrigeration chamber liner 34 is preferably formed from thin, sheet-form material. The liner 34 may be arranged within the chamber 18 adjacent to only one side wall, but, as described above, it is preferably arranged adjacent to a plurality of side walls of the chamber 18. In this embodiment, the liner 34 is positioned adjacent to the four vertical side walls of the chamber 18 and such that it is spaced from each of said side walls. As such, the liner 34 divides a volume of said refrigeration chamber 18 into a main central volume 36 for accommodating one or more objects in a cool refrigerated environment and a minor peripheral volume 38 for receiving one or more thermally conductive passive cooling devices 40. By 'passive' is meant that the cooling devices 40 are not powered cooling devices, but are adapted to absorb thermal energy from their surroundings after having been initially cooled. The arrangement of the refrigeration apparatus cabinet 12 is such that, when a power supply to the refrigeration system 26 is stopped, the one or more thermally conductive passive cooling devices 40 which have been cooled then absorb thermal energy to thereby reduce or slow a rate of temperature rise within at least the main central volume 36 of the refrigeration chamber 18.

The liner 34 is preferably formed of thermally conductive sheet-form material such as, but not essentially, a metal based sheet-form material. The metal based sheet-form material may comprise steel and preferably stainless steel, but in some embodiments the liner 34 may be formed from aluminium sheet material. The sheet material may be meshed sheet material or non-meshed sheet material. The sheet material is preferably less than 2 mm in thickness and preferably not more than 1 mm in thickness.

Figure 4:
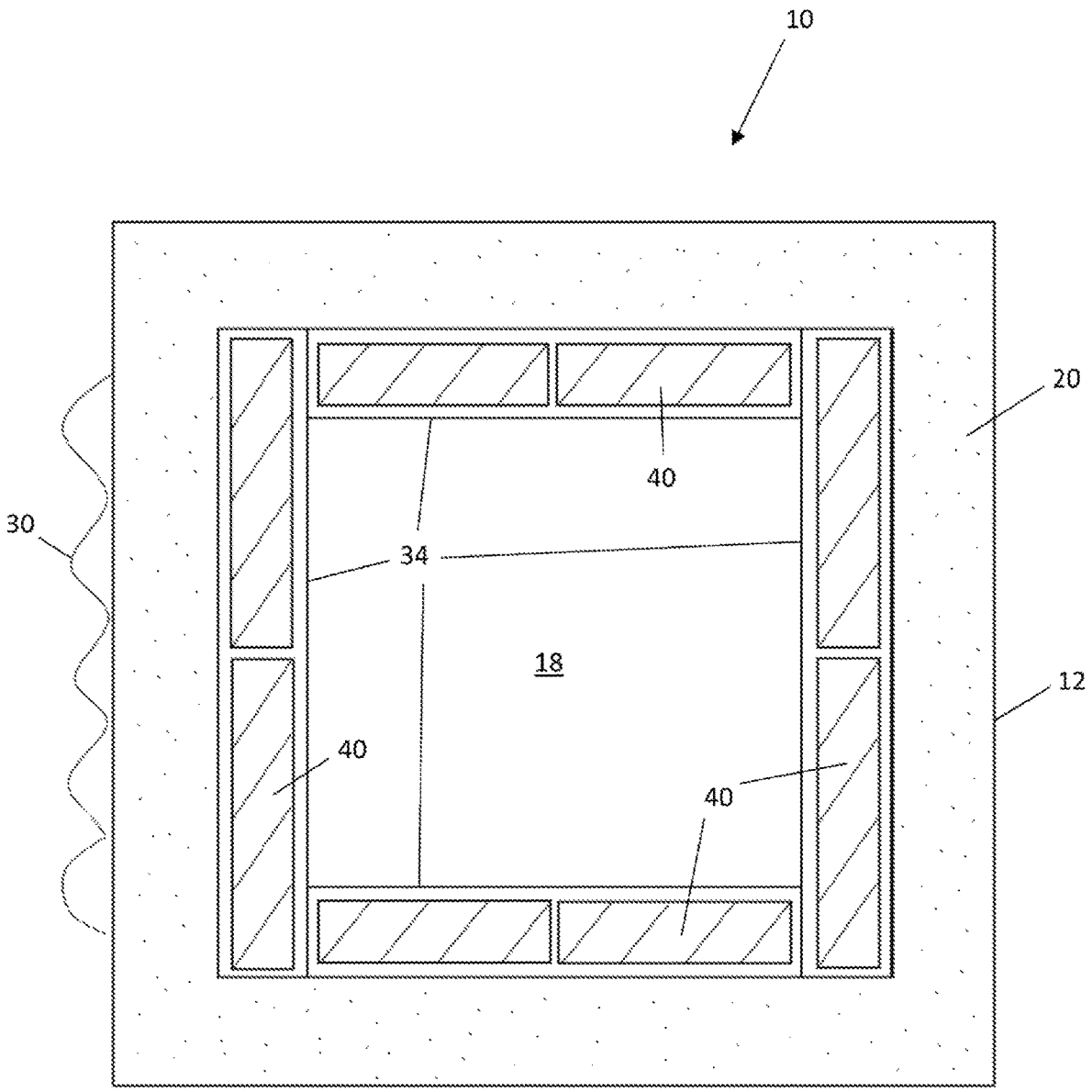
FIG. 4 is a top view looking inside the storage chamber of any of the embodiments of FIGS. 1 to 3.
Figure 5:
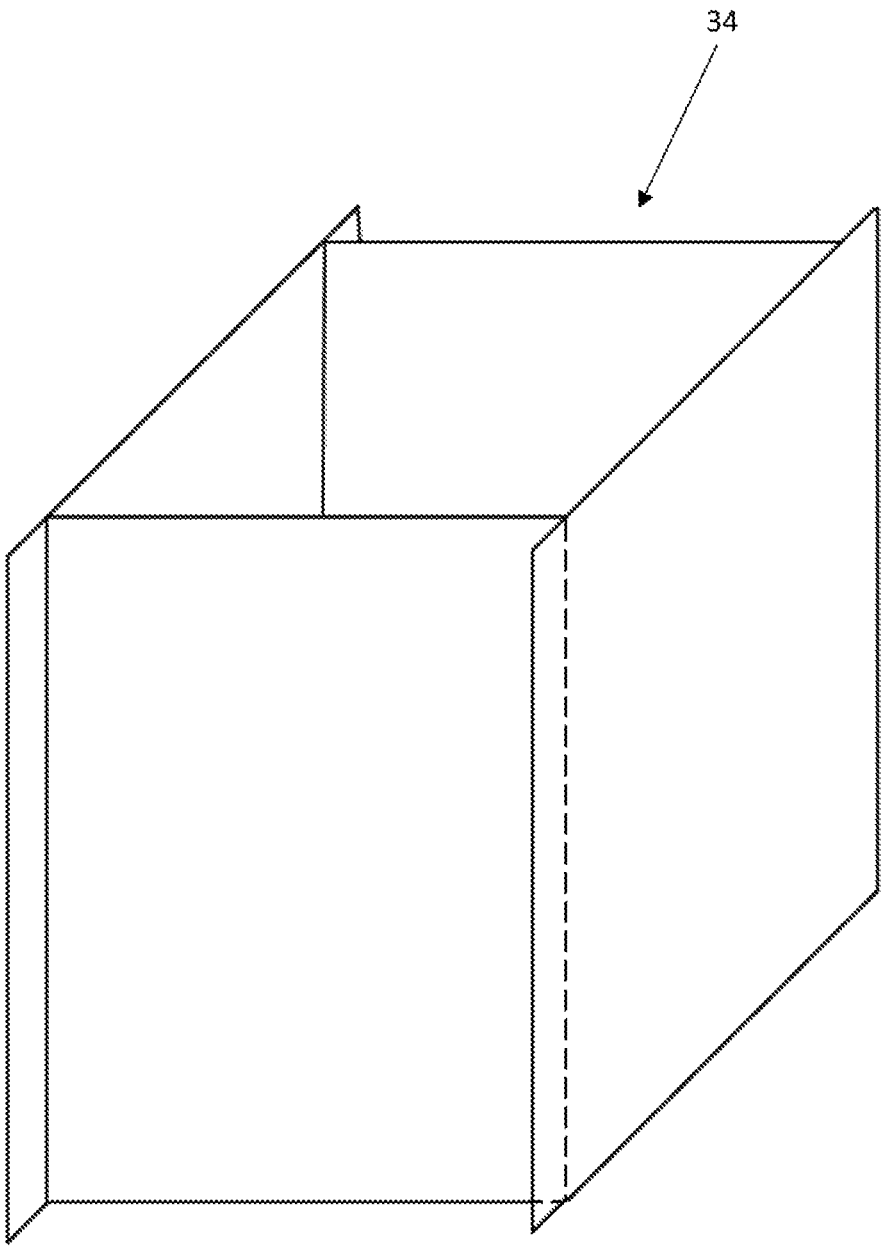
FIG. 5 is a perspective view of one embodiment of a liner for any of the embodiments of FIGS. 1 to 3.

As can be seen in FIGS. 4 and 5, the liner 34 is formed from four thin vertical sheets of material adjoined such that the liner 34 can be manually removed from and manually inserted into the refrigeration chamber 18 of the apparatus 10. Manual removable of the liner 34 from the chamber 18 affords easier cleaning of the chamber. Furthermore, it will be understood that a liner 34 of the type described can be utilized to quickly convert a conventional refrigeration and/or freezer apparatus into a mobile refrigeration apparatus in accordance with the present invention. Such a conversion may require the addition of wheels to the base of such conventional apparatus if no wheels are provided or if the wheels provided are not sufficiently rugged.

Forming the liner 34 from a thermally conducting material has the benefit that it enhances thermal energy intake by the passive cooling devices 40 when power to the refrigeration system 26 is stopped.

The thermally conductive passive cooling devices 40 may comprise cooling blocks comprising solid blocks of thermally conductive material such as a metal material, e.g. steel, but preferably comprise liquid filled blocks. Liquid filled blocks for cooling are known and are commonly referred to as 'freezer blocks'. Such conventional blocks which often comprise a high-density polyethylene (HDPE) container filled with a freezable liquid are suitable as the thermally conductive passive cooling devices 40 for the embodiments of the invention. Thus, the blocks can be bought off the shelf. In consequence, a conversion kit for modifying a conventional refrigeration or freezer apparatus into an embodiment of the invention requires only some thin sheet-form material for forming a liner, one or more HDPE liquid filled freezer blocks and possibly also some wheels.

The liner 34 is preferably arranged within the chamber 18 such that some or all of the passive cooling blocks 40 are manually accessible and removable from the minor peripheral volume 38 formed between the side walls of the liner 34 and the side walls defining the chamber 18.

Where the embodiment of FIG. 1 comprises a mobile warming apparatus 10 having generally the structure shown in FIG. 1 except for replacing the refrigeration system 26 comprising the compressor 28, the condenser 30 and the expansion valve 32 by a temperature changing system comprising a heating system (which is denoted by only box 28 in FIG. 1) for raising a temperature level of said warming chamber 18 when the heating system is powered by a power supply, the storage chamber comprises a warming chamber 18; the storage chamber liner comprises a warming chamber liner 34; and the one or more thermally conductive passive temperature control devices comprise one or more thermally conductive passive heating devices 40 to control the temperature level of the warming chamber 18 by reducing a rate of temperature fall within the main central volume of the warming chamber 18 when the power supply to the heating system is stopped. The one or more thermally conductive passive heating devices 40 may each comprise a solid block of thermally conductive material which, when heated, slowly releases heat energy or a liquid filled block containing a liquid which, when heated, also slowly releases heat energy to its surrounding environment. The heating system may have an associated heating element of conventional type. The heating system may be integrated with the warming apparatus 10. Or, the heating system may be formed as a stand-alone unit which is connected as required to the warming apparatus 10 to warm up the storage chamber 18. Or, the heating system may be formed as a detachable unit which is connected as required to the warming apparatus 10 to warm up the storage chamber 18.

Figure 2:
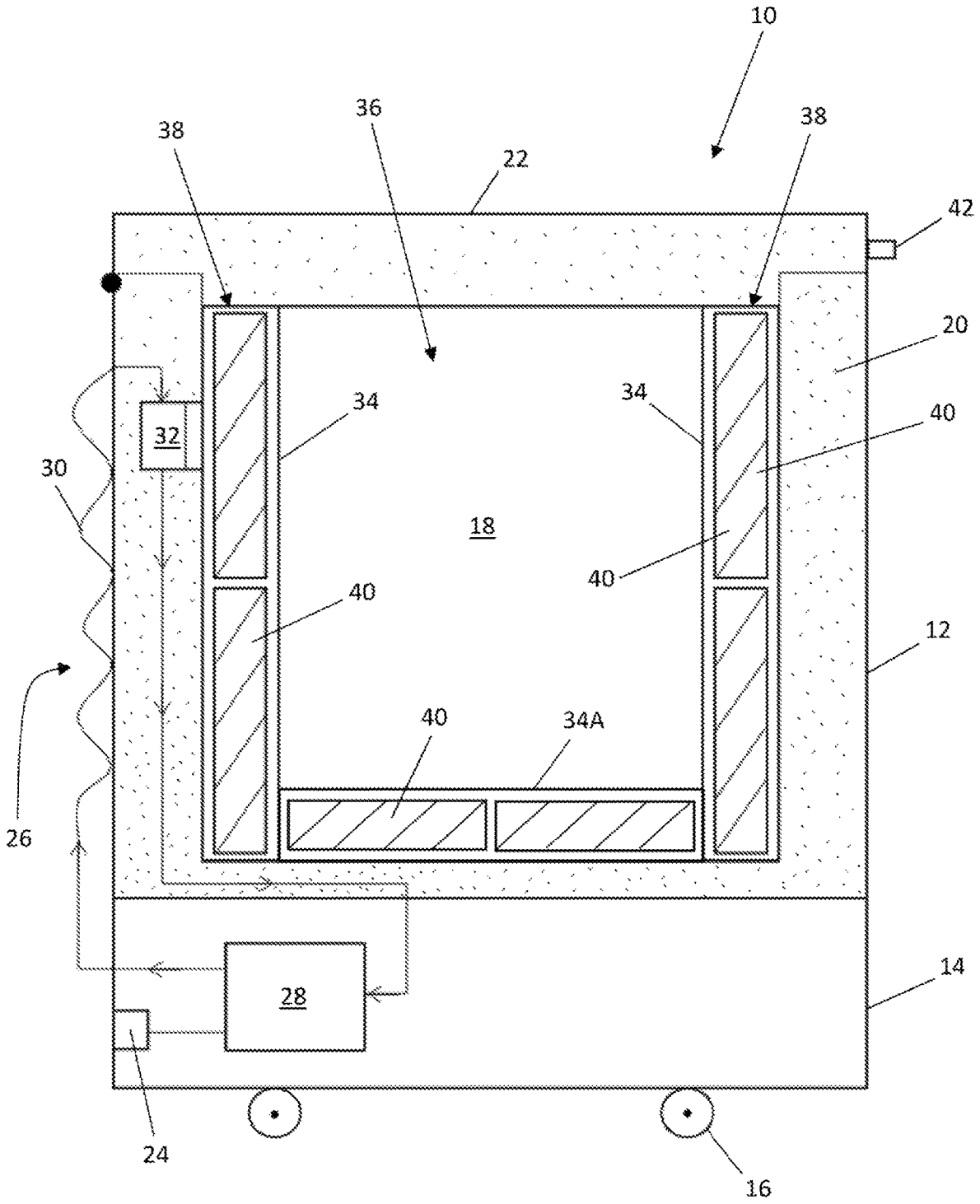
FIG. 2 is a side view of a mobile storage apparatus in accordance with a second embodiment of the invention.

FIG. 2 shows a second embodiment of the storage apparatus 10 according to the invention.

Whilst the following description of this embodiment refers to a mobile refrigeration apparatus 10, it will be understood that the apparatus 10 could equally be used as a warming apparatus or heat retention apparatus where the refrigeration system 26 for cooling the storage chamber 18 of the apparatus is replaced by a heating system for raising a temperature level of the storage chamber 18.

In the following description, like numerals to those used with respect to FIG. 1 will be used to denote like parts.

The embodiment of FIG. 2 differs from the embodiment of FIG. 1 in that the embodiment of FIG. 2 includes a bottom sheet-form wall 34A of the liner 34 which slightly reduces further the size of the main central volume 36 of the chamber 18, but increases the minor peripheral volume 38 to allow an increase in the number of passive cooling blocks 40 to be inserted into the chamber 18. It will be appreciated that the additional blocks 40 placed on the floor of the chamber 18 are placed in position before the liner 34 is inserted.

The embodiment of the storage apparatus shown in FIG. 2 may comprise a mobile warming apparatus 10 having generally the structure shown in FIG. 2 save for replacing the refrigeration system 26 by a temperature changing system comprising a heating system for raising a temperature level of said warming chamber 18 when the heating system is powered by a power supply.

Figure 3:
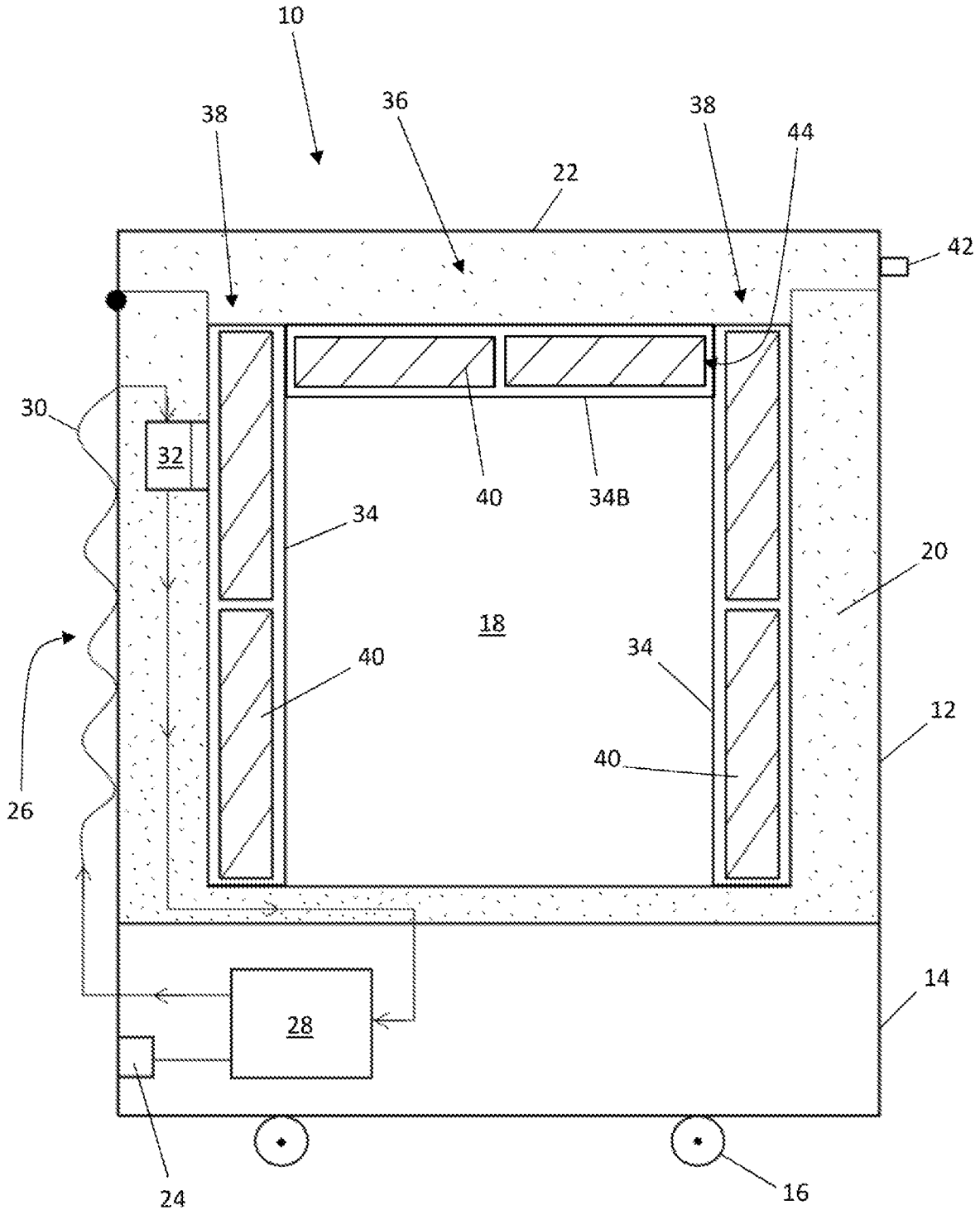
FIG. 3 is a side view of a mobile storage apparatus in accordance with a third embodiment of the invention.

FIG. 3 shows a third embodiment of the storage apparatus 10 according to the invention.

Whilst the following description of this embodiment refers to a mobile refrigeration apparatus 10, it will be understood that the apparatus 10 could equally be used as a warming apparatus or heat retention apparatus where the refrigeration system 26 for cooling the storage chamber 18 of the apparatus is replaced by a heating system for raising a temperature level of the storage chamber 18.

In the following description, like numerals to those used with respect to FIG. 1 will be used to denote like parts. The embodiment of FIG. 3 differs from the embodiment of FIG. 1 in that the embodiment of FIG. 3 includes a top sheet-form wall 34B of the liner 34 attached to an underside of the lid 22 to provide a part of the minor peripheral volume 38 for receiving one or more thermally conductive passive cooling blocks 40 between said top sheet-form wall 34B and said underside of the lid 22. The top sheet-form wall 34B of the liner 34 slightly reduces further the size of the main central volume 36 of the chamber 18, but increases the minor peripheral volume 38 to allow an increase in the number of passive cooling blocks 40 to be inserted into the chamber 18. It will be appreciated that the top wall 34B may be separately attached to the underside of the lid 22 and that additional blocks 40 may be placed in the space between the top wall 34B and the underside of the lid 22 from a front opening 44 in the space formed between the top sheet-form wall 34B and the underside of the lid 22.

The embodiment of the storage apparatus shown in FIG. 3 may comprise a mobile warming apparatus 10 having generally the structure shown in FIG. 3 save for replacing the refrigeration system 26 by a temperature changing system comprising a heating system for raising a temperature level of said warming chamber 18 when the heating system is powered by a power supply.

It will be understood that the alternative arrangements of FIGS. 2 and 3 may be combined into a single embodiment such that all six walls of the chamber 18 are lined by walls of the liner 34.

FIG. 4 shows a top view looking inside the storage chamber 18 of any of the embodiments of FIGS. 1 to 3. FIG. 5 shows a perspective view of one embodiment of the liner 34 or a part of the liner 34 for any of the embodiments of FIGS. 1 to 3.

Figure 6:
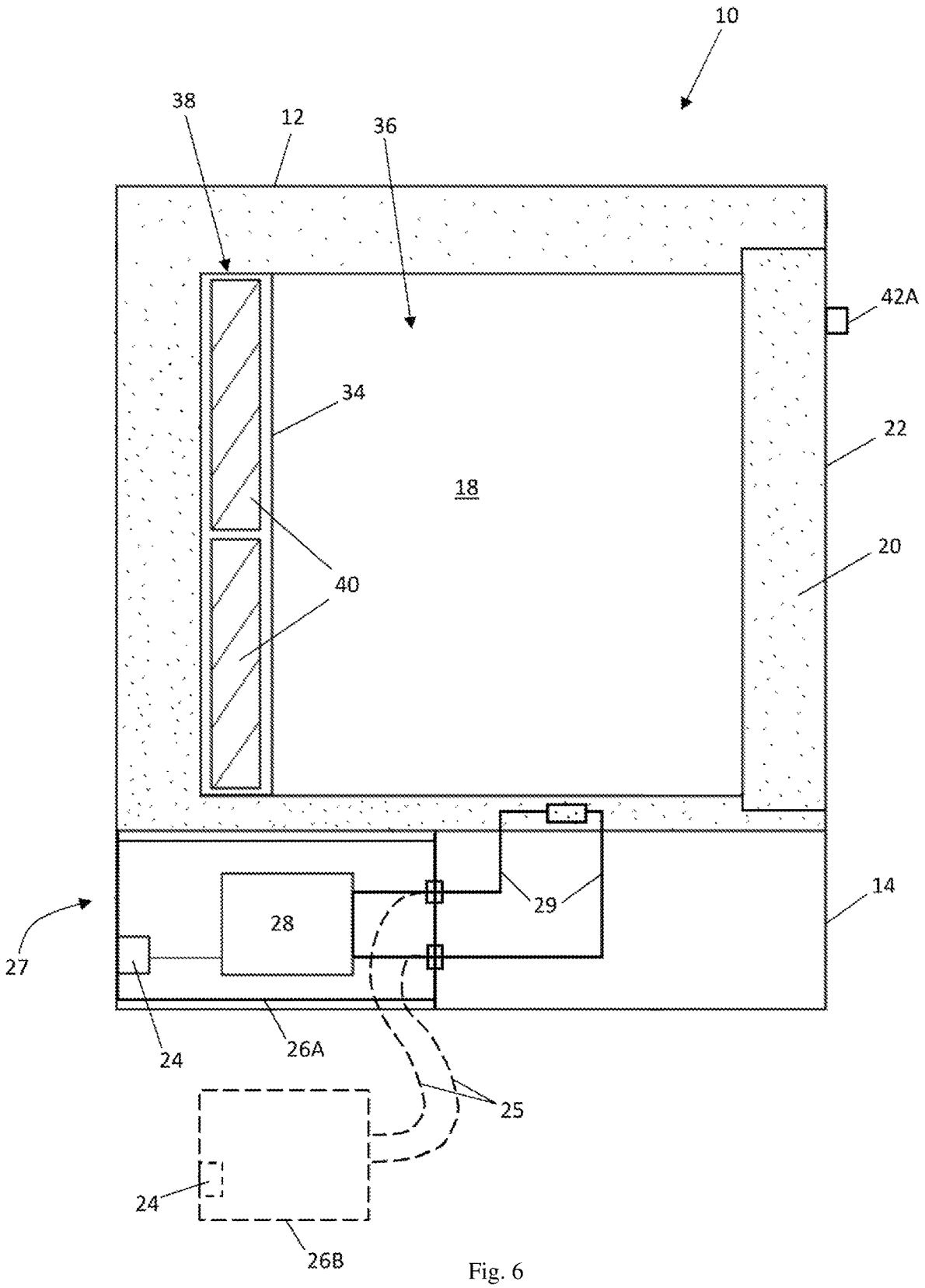
FIG. 6 is a side view of a mobile storage apparatus in accordance with a fourth embodiment of the invention.

FIG. 6 shows a fourth embodiment of the storage apparatus 10 according to the invention.

Whilst the following description of this embodiment refers to a mobile refrigeration apparatus 10, it will be understood that the apparatus 10 could equally be used as a warming apparatus or heat retention apparatus where the refrigeration system 26A,B for cooling the storage chamber 18 of the apparatus is replaced by a detachable or stand-alone heating unit for raising a temperature level of the storage chamber 18.

In the following description, like numerals to those used with respect to FIG. 1 will be used to denote like parts. In the embodiments of FIGS. 1 to 4, the refrigeration system 26 comprises an integral part of the refrigeration apparatus 10. In the embodiment of FIG. 6, the refrigeration system 26 may comprise a detachable unit 26A which is manually attachably received into and manually detachably removable from a cavity 27 or the like in the refrigeration apparatus base. In use, the detachable refrigeration system unit 26A may be received in the cavity 27 whereby it connects to fluid lines 29 or the like which enable it to cool or freeze the refrigeration chamber environment and any contents. Alternatively, where the refrigeration system comprises a stand-alone unit 26B (shown by dashed lines in FIG. 6), the stand-alone unit 26B may be attached by its own fluid lines 25 to the fluid lines 29 of the refrigeration apparatus 10 to cool or freeze the refrigeration chamber 18 environment and any contents. It will be understood that use of a detachable or stand-alone refrigeration system unit may be utilized in any of the embodiments of FIGS. 1 to 4.

In this embodiment, the refrigeration apparatus 10 does not comprise a closable lid, but has a closable door 42A at a front thereof. It will be understood that the liner 34 for the refrigeration chamber 18 will be adapted from that shown in FIG. 4 to accommodate the fact that the apparatus 10 has a closable front door 42A rather than a closable lid. The liner 34 may be fixed within the refrigeration chamber 18 or may be manually removable. It will be understood that any of the embodiments of FIGS. 1 to 4 may employ a front door rather than a top lid and may also have a fixedly attached liner within the chamber.

Also, in this embodiment, the base of the cabinet has no wheels, but the cabinet 12 may be rendered mobile by being made a size and weight that enables it to be manually carried for at least short distances such that said apparatus 10 may be mounted into the trunk of an automobile or onto a rack of a motorcycle, for example. By making the refrigeration system 26 a stand-alone unit 26B or a detachable unit 26A reduces the weight of the apparatus 10 thereby assisting its ability to be manually carried or lifted for loading into a vehicle or onto a trolley or the like. It will be understood that, even for the embodiments of FIGS. 1 to 4 which do include a wheeled base, these embodiments may also be of a sufficiently small enough size and weight as to be able to be manually carried by a single person and/or able to be manually lifted into a vehicle or onto a trolley or the like.

The detachable refrigeration system unit 26A or the stand-alone refrigeration system unit 26B may be provided at 'cooling' stations whereby a refrigeration apparatus 10 not having an integrated refrigeration system may be connected to such a station as required to lower the temperature of its refrigeration chamber. As such, a single cooling station could be used for a plurality of refrigeration apparatuses 10 thereby reducing the number of detachable or stand-alone refrigeration system units 26A,B required for a set number of refrigeration apparatuses 10.

The embodiment of the storage apparatus shown in FIG. 6 may comprise a mobile warming apparatus 10 having generally the structure shown in FIG. 6 save for replacing the detachable or stand-alone refrigeration unit 26A,B by a temperature changing system comprising a detachable or stand-alone heating unit for raising a temperature level of said warming chamber 18 when the heating unit is powered by a power supply.

It will be understood that, for any of the embodiments of the invention, the storage apparatus when comprising a refrigeration apparatus 10 may be employed as a freezer apparatus operating at temperatures below freezing point, or as a cooling apparatus operating at low temperatures above freezing point, or even as an apparatus operating at low temperatures spanning the freezing point dependent on the applications/services for which the apparatuses 10 are utilised.

A series of comparative tests were conducted to demonstrate the unexpected benefits of the present invention. Whilst these tests were conducted on a refrigeration apparatus, it will be understood that results showing a similar degree of effect in respect of retarding a rate of temperature level reduction in the storage chamber could be expected for a warming apparatus as defined herein.

In the test results presented herein, a reference to a "chilling panel" is a reference to a HDPE liquid filled cooling or freezer block as hereinbefore described and a reference to a "bonnet" is a reference to the lid of the refrigeration apparatus. In the tests, a chamber of a conventional refrigeration/freezer apparatus was divided into two parts, one part modified to contain the liner and chilling panels in accordance with the invention and a remaining part of the chamber not modified, but maintained and operated in its original form. The temperature profiles of the two parts of the chamber—original vs modified—were measured to determine the effect of the modification in accordance with the invention.

A first comparative test was conducted on a 201 litre freezer apparatus having the following specification:

Construction Data

TABLE 1

| | Modified Chamber Part | Original Freezer Chamber |
|---|---|---|
| Dimension | 54 × 44 × 64 cm | 60 × 50 × 67 cm |
| Litre capacity | 152 Litre | 201 Litre |
| Cubic meter | 0.152 cbm | 0.201 cbm |

Capacity difference for build-in of chilling panels/blocks×14 pcs.

TABLE 2

| | | | |
|---|---|---|---|
| Litre capacity: | 49 Litre | Cubic meter: | 0.049 cbm |

In this case, the original chamber was divided to provide a first part of 49 litres capacity in unmodified form alongside a 152 lite capacity part modified according to the invention.

Construction Data of Chilling Panels/Blocks

TABLE 3

| | |
|---|---|
| Material: | HDPE |
| Measurement: | 385 × 240 × 20 mm |
| Net Weight: | 335 grams (+/−5 g) |
| Liquid Fill: | 1415 ml (+/−4 ml) |
| Gross Weight: | 1750 grams (+/−10 g) |
| Extruder: | 125 mm |

Total dimension of chilling panels×14 pieces

Cubic meter: 0.001848×14 pieces=0.025872 cbm

FIG. 7 comprises the comparative results for the test conducted on the 201 litre refrigeration apparatus having a 152 litre part of its original chamber modified in accordance with the invention to thereby compare temperature profiles over time for an unmodified part of the refrigeration apparatus chamber operating in a conventional mode and for the refrigeration apparatus chamber part adapted according to the present invention.

In this case, the testing conditions or protocol are as indicated in FIG. 7.

FIG. 7 shows that a refrigeration apparatus 10 modified according to one or more of the embodiments of the invention provides a temperature profile 100 over time which is lower than the temperature profile 110 for the refrigeration/freezer apparatus operated in a conventional manner.

A second series of comparative tests was conducted on the 201 litre freezer apparatus having the following specification:

Construction Data

TABLE 4

| | Modified Chamber Part | Original Freezer Chamber |
|---|---|---|
| Dimension | 54 × 44 × 67 cm | 60 × 50 × 67 cm |
| Litre capacity | 160 Litre | 201 Litre |
| Cubic meter | 0.160 cbm | 0.201 cbm |

Capacity difference for build-in chilling panels/blocks×12 pcs.

TABLE 5

| | | | |
|---|---|---|---|
| Litre capacity: | 41 Litre | Cubic meter: | 0.041 cbm |

In this case, the original chamber was divided to provide a first part of 41 litres capacity in unmodified form alongside a 160 lite capacity part modified according to the invention.

Construction Data of Chilling Panels/Blocks

TABLE 6

| | |
|---|---|
| Material: | HDPE |
| Measurement: | 385 × 240 × 20 mm |
| Net Weight: | 335 grams (+/−5 g) |
| Liquid Fill: | 1415 ml (+/−4 ml) |
| Gross Weight: | 1750 grams (+/−10 g) |
| Extruder: | 125 mm |

Total dimension of chilling panels×12 pieces

Cubic meter:0.001848×12 pieces=0.022176 cbm

FIG. 8 comprises the comparative results for the first test conducted on the 201 litre refrigeration apparatus having a 160 litre part of its original chamber modified in accordance with the invention to thereby compare temperature profiles over time for an unmodified part of the refrigeration apparatus chamber operating in a conventional mode and for the refrigeration apparatus chamber part adapted according to the present invention.

In this case, the testing conditions or protocol are as indicated in FIG. 8.

FIG. 8 shows that a refrigeration apparatus 10 modified according to one or more of the embodiments of the invention provides a temperature profile 100 over time which is consistently lower than the temperature profile 110 for the refrigeration/freezer apparatus operated in a conventional manner.

FIG. 9 comprises the comparative results for the second test conducted on the 201 litre refrigeration apparatus having a 160 litre part of its original chamber modified in accordance with the invention. A different testing protocol to that for FIG. 8 was used. The different testing protocol is as indicated in FIG. 9.

FIG. 9 also shows that a refrigeration apparatus 10 modified according to one or more of the embodiments of the invention provides a temperature profile 100 over time which is consistently lower than the temperature profile 110 for the refrigeration/freezer apparatus operated in a conventional manner.

FIG. 10 comprises the comparative results for the third test conducted on the 201 litre refrigeration apparatus having a 160 litre part of its original chamber modified in accordance with the invention. A different testing protocol to that for FIG. 8 or FIG. 9 was used. The different testing protocol is as indicated in FIG. 10.

FIG. 10 further shows that a refrigeration apparatus 10 modified according to one or more of the embodiments of the invention provides a temperature profile 100 over time which is consistently lower than the temperature profile 110 for the refrigeration/freezer apparatus operated in a conventional manner.

FIG. 11 comprises the comparative results for the fourth test conducted on the 201 litre refrigeration apparatus having a 160 litre part of its original chamber modified in accordance with the invention. Yet a different testing protocol to that for any of FIGS. 8 to 10 was used. The different testing protocol is as indicated in FIG. 11.

FIG. 11 also demonstrates that a refrigeration apparatus 10 modified according to one or more of the embodiments of the invention provides a temperature profile 100 over time which is consistently lower than the temperature profile 110 for the refrigeration/freezer apparatus operated in a conventional manner and which is less susceptible to fluctuations in temperature profile when the refrigeration apparatus power is switched on for a period of time and then off.

FIG. 12 comprises the comparative results for the fourth test conducted on the 201 litre refrigeration apparatus having a 160 litre part of its original chamber modified in accordance with the invention. Yet a different testing protocol to that for any of FIGS. 8 to 11 was used. The different testing protocol is as indicated in FIG. 12.

FIG. 12 also demonstrates that a refrigeration apparatus 10 modified according to one or more of the embodiments of the invention provides a temperature profile 100 (series 1) over time which is consistently lower than the temperature profile 110 (series 2) for the refrigeration/freezer apparatus operated in a conventional manner. By way of a further comparison, a temperature profile 120 (series 3) was obtained for the freezer compartment when the whole of the refrigeration apparatus chamber was operated in a conventional manner, i.e. no part of the chamber was modified in accordance with the invention.

FIG. 13 comprises the comparative results for the fourth test conducted on the 201 litre refrigeration apparatus having a 160 litre part of its original chamber modified in accordance with the invention. Yet a different testing protocol to that for any of FIGS. 8 to 12 was used. The different testing protocol is as indicated in FIG. 13.

FIG. 13 also demonstrates that a refrigeration apparatus 10 modified according to one or more of the embodiments of the invention provides a temperature profile 100 (series 1) over time which is consistently lower than the temperature profile 110 (series 2) for the refrigeration/freezer apparatus operated in a conventional manner. By way of a further comparison, a temperature profile 120 (series 3) was obtained for the freezer compartment when the whole of the refrigeration apparatus chamber was operated in a conventional manner, i.e. no part of the chamber was modified in accordance with the invention.

Based on the test results, it is determined that a preferred ratio of the main central volume to the minor peripheral volume of the refrigeration chamber modified according to the invention is in the range from 4:1 to 10:1, optionally in the range from 5:1 to 8:1 and preferably in the range from 5.8:1 to 7.2:1. Furthermore, it is determined that a preferred modified volume of the refrigeration chamber is in the range from 100 to 200 litres, optionally in the range from 140 to 170 litres, and preferably in the range from 150 to 160 litres.

In general, the invention provides a mobile storage apparatus comprising a cabinet preferably having a wheeled base whereby a plurality of wheels mounted to the base enable the cabinet to be manually moved, i.e. pushed or pulled by one or more persons. The cabinet comprises an insulated, closable storage chamber adapted to accommodate one or more objects in a temperature controlled environment. The cabinet may also comprise a power supply or have a connection point for connecting to a power supply. Also provided is a system for changing a temperature level of said storage chamber when the temperature system system is powered by the power supply. Provided is a storage chamber liner. The storage chamber liner is preferably formed from thin, sheet-form material arranged within the chamber adjacent one or more sides of the chamber, but spaced from said one or more sides such that said liner divides a volume of said storage chamber into a main central volume for accommodating one or more objects in a temperature controlled environment and a minor peripheral volume for receiving one or more thermally conductive passive temperature control devices. In use, when a power supply to the temperature level change system is stopped, the one or more thermally conductive passive temperature control devices reduce or slow a rate of temperature change within the main central volume of the storage chamber.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A mobile storage apparatus, said apparatus comprising:

a cabinet comprising:

an insulated, closable storage chamber adapted to accommodate one or more objects in a temperature-controlled environment, the storage chamber having an upper opening closable by an insulated lid;

a system for changing a temperature level of said storage chamber when the system is connected to a power supply; and a storage chamber liner, wherein said storage chamber liner is formed from thin, thermally conductive sheet-form material arranged within the storage chamber adjacent all vertical sides of the storage chamber, but spaced from said vertical sides such that said chamber liner divides a volume of said storage chamber into a main central volume for accommodating the one or more objects in a temperature controlled environment and a minor peripheral volume for receiving one or more thermally conductive passive temperature control devices and wherein the chamber liner includes a bottom sheet-form wall spaced above a floor of the storage chamber to provide a part of the minor peripheral volume for receiving one or more thermally conductive passive temperature control devices between said bottom sheet-form wall and the floor of the storage chamber whereby, when the power supply to the system is stopped, the one or more thermally conductive passive temperature control devices control temperature of the storage chamber by reducing a rate of temperature change within the main central volume of the storage chamber.

2. The mobile storage apparatus of claim 1, wherein:

the storage chamber comprises a refrigeration chamber;

the system for changing temperature comprises a refrigeration system for reducing a temperature level of said refrigeration chamber when the refrigeration system is powered by a power supply; and the storage chamber liner comprises a refrigeration chamber liner.

3. The mobile storage apparatus of claim 1, wherein the storage chamber comprises a warming chamber;

the system for changing a temperature comprises a heating system for raising a temperature level of said warming chamber when the heating system is powered by a power supply; and the storage chamber liner comprises a warming chamber liner.

4. The mobile storage apparatus of claim 2, wherein the refrigeration system is selected from the group consisting of: a refrigeration system forming an integral part of the mobile storage apparatus; and a detachable refrigeration system for the mobile storage apparatus.

5. The mobile storage apparatus of claim 3, wherein the heating system is selected from the group consisting of: a heating system forming an integral part of the mobile storage apparatus; and a detachable heating system for the mobile storage apparatus.

6. The mobile storage apparatus of claim 1, wherein the cabinet has a wheeled base.

7. The mobile storage apparatus of claim 1, wherein the chamber liner is formed from a member of the group consisting of: steel, stainless steel and aluminium sheet-form material.

8. The mobile storage apparatus of claim 1, wherein the chamber liner includes a top sheet-form wall attached to an underside of the lid to provide a part of the minor peripheral volume for receiving one or more thermally conductive passive temperature control devices between said top sheet-form wall and the underside of the lid.

9. The mobile storage apparatus of claim 1, wherein the sheet-form material forming the chamber liner is selected from the group consisting of: a sheet-form material having a thickness less than 2 mm; and a sheet-form material having a thickness no greater than 1 mm.

10. The mobile storage apparatus of claim 1, wherein the chamber liner is manually removable from and manually insertable into the storage chamber or the chamber liner is fixedly attached within the storage chamber.

11. The mobile storage apparatus of claim 1, wherein the one or more thermally conductive passive temperature control devices comprise one or more blocks.

12. The mobile storage apparatus of claim 11, wherein each of the one or more blocks comprises a solid block of thermally conductive material.

13. The mobile storage apparatus of claim 11, wherein each of the one or more blocks comprises a liquid filled block.

14. The mobile storage apparatus of claim 11, wherein at least some of the one or more thermally conductive passive temperature control devices are manually removable from the minor peripheral volume in the storage chamber.

15. The mobile storage apparatus of claim 1, wherein a ratio of the main central volume to the minor peripheral volume of the storage chamber is in the range from 4:1 to 10:1.

16. The mobile storage apparatus of claim 1, wherein the volume of the storage chamber is in the range from 100 to 200 litres.

17. A method of preparing a mobile storage apparatus, the method comprising:

providing a cabinet having an insulated, closable storage chamber, the storage chamber having an upper opening closable by an insulated lid; and arranging a chamber liner in said insulated, closable storage chamber of said mobile storage apparatus, said chamber liner being formed from thin, thermally conductive sheet-form material, the method including arranging said chamber liner within the storage chamber adjacent all vertical sides of the storage chamber, but spaced from said vertical sides such that said chamber liner divides a volume of said storage chamber into a main central volume for accommodating one or more objects in a temperature controlled environment and a minor peripheral volume for receiving one or more thermally conductive passive temperature control devices, the method including arranging the chamber liner to include a bottom sheet-form wall spaced above a floor of the storage chamber to provide a part of the minor peripheral volume for receiving one or more thermally conductive passive temperature control devices between said bottom sheet-form wall and the floor of the storage chamber;

providing a system for changing a temperature level of the storage chamber when said system is powered by a power supply; and when the power supply to the temperature changing system is stopped, the one or more thermally conductive passive temperature control devices reducing a rate of temperature change within the main central volume of the storage chamber.

* * * * *